US009208715B2

(12) United States Patent
Kim et al.

(10) Patent No.: US 9,208,715 B2
(45) Date of Patent: Dec. 8, 2015

(54) DISPLAY DEVICE WITH THRESHOLD VOLTAGE COMPENSATION AND DRIVING METHOD THEREOF

(71) Applicant: SAMSUNG DISPLAY CO., LTD., Yongin-si, Gyeonggi-do (KR)

(72) Inventors: Min-Cheol Kim, Yongin-si (KR); In-Hwan Kim, Yongin-si (KR); Byung-Geun Jun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 344 days.

(21) Appl. No.: 13/663,047

(22) Filed: Oct. 29, 2012

(65) Prior Publication Data

US 2014/0009456 A1 Jan. 9, 2014

(30) Foreign Application Priority Data

Jul. 6, 2012 (KR) ..... 10-2012-0074176

(51) Int. Cl.
*G09G 3/30* (2006.01)
*G09G 3/32* (2006.01)

(52) U.S. Cl.
CPC ..... *G09G 3/3208* (2013.01); *G09G 3/3233* (2013.01); *G09G 3/3258* (2013.01); *G09G 3/3291* (2013.01); *G09G 2300/0819* (2013.01); *G09G 2300/0842* (2013.01); *G09G 2300/0861* (2013.01); *G09G 2310/0262* (2013.01); *G09G 2310/067* (2013.01); *G09G 2320/043* (2013.01); *G09G 2320/045* (2013.01)

(58) Field of Classification Search
CPC ..... G09G 3/3233; G09G 3/3258; G09G 2320/045
USPC ..... 345/76, 82
See application file for complete search history.

(56) References Cited

U.S. PATENT DOCUMENTS

| | | | | |
|---|---|---|---|---|
| 2008/0246697 | A1* | 10/2008 | Kim | 345/76 |
| 2009/0219232 | A1* | 9/2009 | Choi | 345/76 |
| 2010/0156875 | A1* | 6/2010 | Kim et al. | 345/211 |
| 2012/0038683 | A1* | 2/2012 | Park et al. | 345/690 |
| 2012/0105420 | A1* | 5/2012 | Choi | 345/212 |

FOREIGN PATENT DOCUMENTS

| | | | |
|---|---|---|---|
| JP | 2008-083084 | A | 4/2008 |
| KR | 10-2006-0056791 | A | 5/2006 |
| KR | 10-2010-0037569 | A | 4/2010 |

* cited by examiner

*Primary Examiner* — Chanh Nguyen
*Assistant Examiner* — Yuzhen Shen
(74) *Attorney, Agent, or Firm* — Christie, Parker & Hale, LLP

(57) ABSTRACT

A display device is provided that can provide sufficient time for threshold voltage compensation of a driving transistor of each pixel during high-speed driving of the display device, and a method for driving the same. A data writing and threshold voltage compensation step of pixels at odd and even-numbered lines are concurrently performed during an extended time period so that the time available for threshold voltage compensation of the driving transistors can be increased.

33 Claims, 6 Drawing Sheets

DISPLAY DEVICE WITH THRESHOLD VOLTAGE COMPENSATION AND DRIVING METHOD THEREOF

CROSS-REFERENCE TO RELATED APPLICATION

This application claims priority to and the benefit of Korean Patent Application No. 10-2012-0074176 filed in the Korean Intellectual Property Office on Jul. 6, 2012, the entire contents of which are incorporated herein by reference.

BACKGROUND (a) Field

The present invention relates to a display device and a driving method thereof.

(b) Description of the Related Art

A display device includes a display panel composed of a plurality of pixels arranged in a matrix. The display panel includes a plurality of scan lines extending in a row direction and a plurality of data lines extending in a column direction, and the plurality of scan lines and the plurality of data lines cross each other. The plurality of pixels are respectively driven by scan signals and data signals respectively transmitted from the corresponding scan lines and data lines.

Recently, a display panel has been gradually increased in size, and the size increase of the display panel requires high-speed driving. That is, as the display panel is increased in size, faster data writing into a plurality of pixels is needed.

As the data writing time is shortened, a threshold voltage of a driving transistor included in each of the plurality of pixels may not be sufficiently compensated. If the threshold voltage of the driving transistor cannot be sufficiently compensated, image blur may occur due to threshold voltage variation in a low-gray image.

The above information disclosed in this Background section is only for enhancement of understanding of the background of the invention and therefore it may contain information that does not form the prior art that is already known in this country to a person of ordinary skill in the art.

SUMMARY

Embodiments of the present invention have been made in an effort to provide a display device that can sufficiently assure time for compensating a threshold voltage of a driving transistor in high-speed driving, and a method for driving the same.

A display device according to an exemplary embodiment of the present invention includes: a scan driver configured to apply scan signals of a (k−1)-th odd-numbered line and a k-th odd-numbered line to a pixel of the k-th odd-numbered line, and apply the scan signal of the (k−1)-th odd-numbered line, the scan signal of the k-th odd-numbered line, and a scan signal of a k-th even-numbered line to a pixel of the k-th even-numbered line (here, k is an integer and greater than 2); and a data driver configured to apply a first data signal of the k-th odd-numbered line to data lines respectively connected to a pixel of the k-th odd-numbered line and a pixel of the k-th even-numbered line corresponding to the scan signal of the k-th odd-numbered line, and apply a second data signal of the k-th even-numbered line to the data line corresponding to the scan signal of the k-th even-numbered line, and a threshold voltage of a driving transistor of the pixel of the k-th odd-numbered line and a threshold voltage of a driving transistor of the pixel of the k-th even-numbered line are compensated for, according to the scan signal of the k-th odd-numbered line.

A gate voltage of the driving transistor of the pixel of the k-th odd-numbered line and a gate voltage of the driving transistor of the pixel of the k-th even-numbered line may be reset according to the scan signal of the (k−1)-th odd-numbered line.

A first data signal that is compensated for the threshold voltage of the driving transistor according to the scan signal of the k-th odd-numbered line, may be input to the pixel of the k-th odd-numbered line.

A second data signal that is compensated for the threshold voltage of the driving transistor according to the scan signal of the k-th even-numbered line, may be input to the pixel of the k-th even-numbered line.

The display device may further include a light emission driver configured to control the pixel of the k-th odd-numbered line and the pixel of the k-th even-numbered line to concurrently emit light by applying a k-th light emission signal to the pixel of the k-th odd-numbered line and the pixel of the k-th even-numbered line.

The pixel of the k-th odd-numbered line may include a switching transistor configured to transmit the first data signal by being turned on by the scan signal of the k-th odd-numbered line, and a driving transistor configured to transmit the first data signal by being diode-connected according to the scan signal of the k-th odd-numbered line.

The pixel of the k-th odd-numbered line may further include a compensation transistor configured to diode-connect the driving transistor by being turned on by the scan signal of the k-th odd-numbered line.

The pixel of the k-th odd-numbered line may further include a storage capacitor coupled between a gate electrode of the driving transistor and a first power source voltage to store the first data signal that is compensated for the threshold voltage of the driving transistor.

The pixel of the k-th odd-numbered line may further include a first light emission transistor configured to be turned on by a k-th light emission signal applied to the pixel of the k-th odd-numbered line and the pixel of the k-th even-numbered line to connect a second electrode of the driving transistor to an organic light emitting diode, and a second light emission transistor configured to be turned on by the k-th light emission signal to transmit a first power source voltage to a first electrode of the driving transistor.

The pixel of the k-th even-numbered line may include: a first switching transistor configured to be turned on by the scan signal of the k-th odd-numbered line to transmit the first data signal; a driving transistor configured to be diode-connected according to the scan signal of the k-th odd-numbered line to transmit the first data signal; a second switching transistor configured to be turned on by the scan signal of the k-th even-numbered line to transmit the second data signal to a gate electrode of the driving transistor; and a first capacitor coupled between the gate electrode of the driving transistor and the second switching transistor.

The pixel of the k-th even-numbered line may further include an initialization transistor configured to be turned on by the scan signal of the (k−1)-th odd-numbered line to transmit an initialization voltage to the gate electrode of the driving transistor.

The pixel of the k-th even-numbered line may further include a compensation transistor configured to be turned on by the scan signal of the k-th odd-numbered line to diode-connect the driving transistor.

The pixel of the k-th even-numbered line may further include a second capacitor coupled between the gate electrode of the driving transistor and a first power source voltage to store a second data signal that is compensated for the threshold voltage of the driving transistor.

The pixel of the k-th even-numbered line may further include a first light emission transistor configured to be turned on by a k-th light emission signal applied to the pixel of the k-th odd-numbered line and the pixel of the k-th even-numbered line to transmit a first power source voltage to a first electrode of the driving transistor, and a second light emission transistor configured to be turned on by the k-th light emission signal to connect a second electrode of the driving transistor to an organic light emitting diode.

A display device according to another exemplary embodiment of the present invention includes: a scan driver configured to apply a scan signal of a (k−1)-th odd-numbered line and a first scan signal of a k-th odd-numbered line to a first pixel of the k-th odd-numbered line, apply the scan signal of the (k−1)-th odd-numbered line, the first scan signal of the k-th odd-numbered line, and a second scan signal of the k-th odd-numbered line to a second pixel of the k-th odd-numbered line, apply the scan signal of the (k−1)-th odd-numbered line, the first scan signal of the k-th odd-numbered line, and a third scan signal of a k-th even-numbered line to a third pixel of the k-th even-numbered line, and apply the scan signal of the (k−1)-th odd-numbered line, the first scan signal of the k-th odd-numbered line, and a fourth scan signal of the k-th even-numbered line to a fourth pixel of the k-th even-numbered line; and a data driver configured to apply a first data signal of the k-th odd-numbered line to the first and second pixels of the k-th odd-numbered line and the third and fourth pixels of the k-th even-numbered line corresponding to the first scan signal of the k-th odd-numbered line, apply a second data signal of the k-th odd-numbered line to the data line corresponding to the second scan signal of the k-th odd-numbered line, apply a third data signal of the k-th even-numbered line to the data line corresponding to the third scan signal of the k-th even-numbered line, and apply a fourth data signal of the k-th even-numbered line to the data line corresponding to the fourth scan signal of the k-th even-numbered line, and threshold voltages of the first and second pixels of the k-th odd-numbered line and threshold voltages of the third and fourth pixels of the k-th even-numbered line are compensated for according to the first scan signal of the k-th odd-numbered line.

Gate voltages of driving transistors of the first and second pixels of the k-th odd-numbered line and gate voltages of driving transistors of the third and fourth pixels of the k-th even-numbered line may be reset according to the scan signal of the (k−1)-th odd-numbered line.

A first data signal that is compensated for the threshold voltage of a driving transistor of the first pixel according to the first scan signal of the k-th odd-numbered line, may be input to the first pixel of the k-th odd-numbered line.

A second data signal that is compensated for the threshold voltage of a driving transistor of the second pixel according to the second scan signal of the k-th odd-numbered line, may be input to the second pixel of the k-th odd-numbered line.

A third data signal that is compensated for the threshold voltage of a driving transistor of the third pixel according to the third scan signal of the k-th even-numbered line, may be input to the third pixel of the k-th even-numbered line.

A fourth data signal that is compensated for the threshold voltage of a driving transistor of the fourth pixel according to the fourth scan signal of the k-th even-numbered line, may be input to the fourth pixel of the k-th even-numbered line.

The display device may further include a light emission driver configured to control the first and second pixels of the k-th odd-numbered line and the third and fourth pixels of the k-th even-numbered line to concurrently emit light by applying a k-th light emission signal to the first and second pixels of the k-th odd-numbered line and the third and fourth pixels of the k-th even-numbered line.

The first pixel of the k-th odd-numbered line may include a switching transistor configured to be turned on by the first scan signal of the k-th odd-numbered line to transmit the first data signal, and a driving transistor configured to be diode-connected according to the first scan signal of the k-th odd-numbered line to transmit the first data signal.

The first pixel of the k-th odd-numbered line may further include a compensation transistor configured to be turned on by the scan signal of the k-th odd-numbered line to diode-connect the driving transistor.

The first pixel of the k-th odd-numbered line may further include a storage capacitor coupled between a gate electrode of the driving transistor and a first power source voltage, to store the first data signal that is compensated for the threshold voltage of the driving transistor.

The first pixel of the k-th odd-numbered line may further include a first light emission transistor configured to be turned on by a k-th light emission signal applied to the first and second pixels of the k-th odd-numbered line and the third and fourth pixels of the k-th even-numbered line to connect a second electrode of the driving transistor to an organic light emitting diode OLED, and a second light emission transistor configured to be turned on by the k-th light emission signal to transmit a first power source voltage to a first electrode of the driving transistor.

The first pixel of the k-th odd-numbered line may further include an initialization transistor configured to be turned on by the scan signal of the (k−1)-th odd-numbered line to transmit an initialization voltage to a gate electrode of the driving transistor.

The second pixel of the k-th odd-numbered line may include: a second driving transistor configured to be diode-connected according to the first scan signal of the k-th odd-numbered line to transmit the first data signal; a second switching transistor configured to be turned on by the second scan signal of the k-th odd-numbered line to transmit the second data signal to a gate electrode of the second driving transistor; a first capacitor coupled between a gate electrode of the second driving transistor and the second switching transistor; and a second capacitor coupled between the gate electrode of the second driving transistor and the first power source voltage to store the second data signal that is compensated for the threshold voltage of the second driving transistor.

The second pixel of the k-th odd-numbered line may further include a second compensation transistor configured to be turned on by the first scan signal of the k-th odd-numbered line to diode-connect the second driving transistor.

The second pixel of the k-th odd-numbered line may further include a third light emission transistor configured to be turned on by the k-th light emission signal when the first power source voltage is transmitted to the first electrode of the second driving transistor by the k-th light emission signal to connect a second electrode of the second driving transistor to the organic light emitting diode.

The third pixel of the k-th even-numbered line may include: a third driving transistor configured to be diode-connected according to the first scan signal of the k-th odd-numbered line to transmit the first data signal; a third switching transistor configured to be turned on by the third scan signal of the k-th even-numbered line to transmit the third data signal to a gate electrode of the third driving transistor; a third capacitor coupled between the gate electrode of the third driving transistor and the third switching transistor; and a fourth capacitor coupled between the gate electrode of the third driving transistor and the first power source voltage to store the third data signal that is compensated for the threshold voltage of the third driving transistor.

The third pixel of the k-th even-numbered line may further include a third compensation transistor configured to be turned on by the first scan signal of the k-th odd-numbered line to diode-connect the second driving transistor.

The third pixel of the k-th even-numbered line may further include a fourth light emission transistor configured to be turned on by the k-th light emission signal when the first power source voltage is transmitted to a first electrode of the third driving transistor by the k-th light emission signal to connect a second electrode of the third driving transistor to the organic light emitting diode.

The fourth pixel of the k-th even-numbered line may include: a fourth driving transistor configured to be diode-connected according to the first scan signal of the k-th odd-numbered line to transmit the first data signal; a fourth switching transistor configured to be turned on by the fourth scan signal of the k-th even-numbered line to transmit the fourth data signal to a gate electrode of the fourth driving transistor; a fifth capacitor coupled between the gate electrode of the fourth driving transistor and the fourth switching transistor; and a sixth capacitor coupled between the gate electrode of the fourth driving transistor and the first power source voltage to store a fourth data signal that is compensated for the threshold voltage of the fourth driving transistor.

The fourth pixel of the k-th even-numbered line may further include a fourth compensation transistor configured to be turned on by the first scan signal of the k-th odd-numbered line to diode-connect the fourth driving transistor.

The fourth pixel of the k-th even-numbered line may further include a fifth light emission transistor configured to be turned on by the k-th light emission signal when the first power source voltage is transmitted to a first electrode of the fourth driving transistor by the k-th light emission signal to connect a second electrode of the fourth driving transistor to the organic light emitting diode.

A display device according to another exemplary embodiment of the present invention provides a method for driving a display device. The method includes: resetting gate voltages of driving transistors respectively included in first and second pixels of the pixels by applying a first scan signal to the first and second pixels; writing a first data signal that is compensated for a threshold voltage of a first driving transistor included in the first pixel to the first pixel by applying a second scan signal and the first data signal to the first pixel; compensating for a threshold voltage of a second driving transistor included in the second pixel by applying the second scan signal and the first data signal to the second pixel; writing a second data signal that is compensated for the threshold voltage of the second driving transistor to the second pixel by applying a third scan signal and the second data signal to the second pixel; and controlling the first and second pixels to concurrently emit light by applying a light emission signal to the first and second pixels.

The first pixel may be a pixel of a k-th odd-numbered line (here, k is an integer, greater than 2), the second pixel is a pixel of a k-th even-numbered line, and the first scan signal is a scan signal of a (k−1)-th odd-numbered line.

The second scan signal may be a scan signal of the k-th odd-numbered line and the third scan signal is a scan signal of the k-th even-numbered line.

The writing the first data signal that is compensated for the threshold voltage of the first driving transistor to the first pixel may include diode-connecting the first driving transistor and transmitting the first data signal through the first driving transistor according to the second scan signal.

The compensating the threshold voltage of the second driving transistor may include diode-connecting the second driving transistor and transmitting the first data signal through the second driving transistor according to the second scan signal.

The writing the second data signal that is compensated for the threshold voltage of the second driving transistor to the second pixel, may include applying the second data signal to a capacitor coupled to a gate electrode of the second driving transistor and writing the second data signal to the gate electrode of the second driving transistor via coupling by the capacitor.

The controlling the first and second pixels to concurrently emit light by applying the light emission signal thereto may include: controlling a first organic light emitting diode to emit light by turning on a first light emission transistor coupled between a first organic light emitting diode and the first driving transistor included in the first pixel and a second light emission transistor coupled between the first driving transistor and a first power source voltage; and controlling a second light emitting diode to emit light by turning on a third light emission transistor coupled between a second organic light emitting diode and the second driving transistor included in the second pixel and a fourth light emission transistor coupled between the second driving transistor and the first power source voltage.

The method may further include resetting gate voltages of the driving transistors included in the third and fourth pixels by applying the first scan signal to the third and fourth pixels.

The method for driving the display device may further include: compensating for a threshold voltage of a third driving transistor included in the third pixel by applying the second scan signal and the first data signal to the third pixel; and compensating for a threshold voltage of a fourth driving transistor included in the fourth pixel by applying the second scan signal and the first data signal to the fourth pixel.

The method may further include: writing a third data signal that is compensated for the threshold voltage of the third driving transistor to the third pixel by applying a fourth scan signal and the third data signal to the third pixel; and writing a fourth data signal that is compensated for the threshold voltage of the fourth driving transistor to the fourth pixel by applying a fifth scan signal and the fourth data signal to the fourth pixel.

The first pixel and the second pixel may be pixels of a k-th odd-numbered line, the third and fourth pixels may be pixels of a k-th even-numbered line, and the first scan signal may be a scan signal of the (k−1)-th odd-numbered line.

The second scan signal may include a scan signal that turns on a switching transistor included in the first pixel, the third scan signal may include a scan signal that turns on a switching transistor included in the second pixel, the fourth scan signal may include a scan signal that turns on a switching transistor included in the third pixel, and the fifth scan signal may include a scan signal that turns on a switching transistor included in the fourth pixel.

The compensating the threshold voltage of the third driving transistor may include diode-connecting the third driving transistor according to the second scan signal and transmitting the first data signal through the third driving transistor.

The compensating the threshold voltage of the fourth driving transistor may include diode-connecting the fourth driving transistor according to the second scan signal and transmitting the first data signal through the fourth driving transistor.

The writing the third data signal that is compensated for the threshold voltage of the third driving transistor to the third pixel may include applying the third data signal to a capacitor coupled to a gate electrode of the third driving transistor and writing the third data signal to the gate electrode of the third driving transistor via coupling of the capacitor.

The writing the fourth data signal that is compensated for the threshold voltage of the fourth driving transistor to the fourth pixel may include applying the fourth data signal to a capacitor coupled to a gate electrode of the fourth driving transistor and writing the fourth data signal to the gate electrode of the fourth driving transistor via coupling of the capacitor.

The method may further include applying the light emission signal to the third and fourth pixels for concurrent light emission of the third and fourth pixels.

The applying the light emission signal to the third and fourth pixels for concurrent light emission may include: turning on a fourth light emission transistor coupled between a third organic light emitting diode and the third driving transistor included in the third pixel when a first power source voltage is transmitted to a first electrode of the third driving transistor by the light emission signal for light emission of the third organic light emitting diode; and turning on a fifth light emission transistor coupled between a fourth organic light emitting diode and the fourth driving transistor included in the fourth pixel when the first power source voltage is transmitted to a first electrode of the fourth driving transistor by the light emission signal for light emission of the fourth organic light emitting diode.

According to embodiments of the present invention, time for compensation of a threshold voltage of a driving transistor can be sufficiently assured in high-speed driving, and the threshold voltage of the driving transistor can be sufficiently compensated so that occurrence of blur in a low-scale image due to threshold voltage variation can be reduced or prevented.

DETAILED DESCRIPTION OF THE EMBODIMENTS

Figure 1:
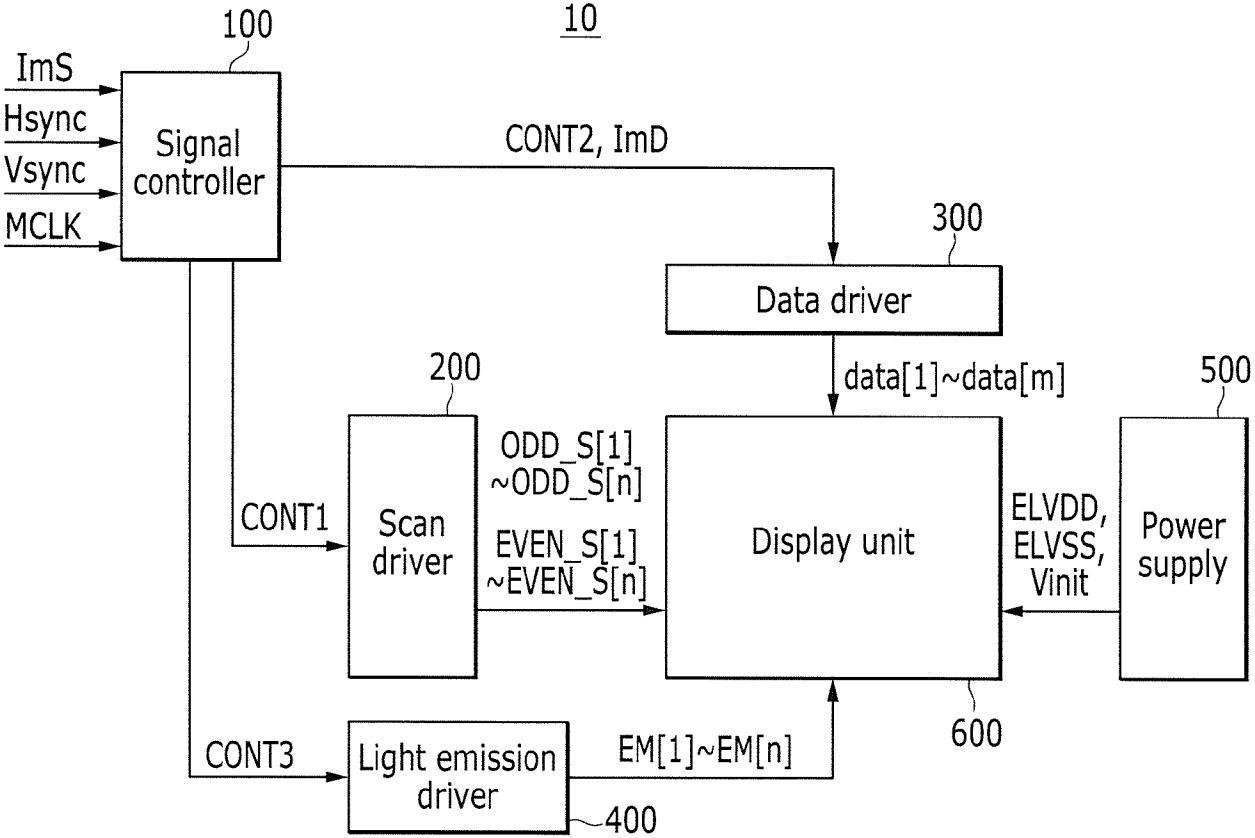
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in several exemplary embodiments, a constituent element having the same configuration will be representatively described in a first exemplary embodiment by using the same reference numeral, and other configurations different from those of the first exemplary embodiment will be described in other exemplary embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment of the present invention.

Referring to FIG. 1, a display device 10 includes a signal controller 100, a scan driver 200, a data driver 300, a light emission driver 400, a power supply 500, and a display unit 600.

The signal controller 100 receives a video signal ImS and a synchronization signal input from an external device. The input video signal ImS includes luminance information for a plurality of pixels. The luminance has a predetermined number of grays (or gray levels), for example, $1024=2^{10}$, $256=2^{8}$ or $64=2^{6}$. The synchronization signal includes a horizontal synchronization signal Hsync, a vertical synchronization signal Vsync, and a main clock signal MCLK.

The signal controller 100 generates first to third driving control signals CONT1, CONT2, CONT3 and an image data signal ImD according to the video signal ImS, the horizontal synchronization signal Hsync, the vertical synchronization signal Vsync, and the main clock signal MCLK.

The signal controller 100 generates the image data signal ImD by dividing the video signal ImS into a frame unit according to the vertical synchronization signal Vsync and dividing the image data signal ImS into a scan line unit according to the horizontal synchronization signal Hsync. The signal controller 100 transmits the image data signal ImD and the second driving control signal CONT2 to the data driver 300.

The display unit 600 has a display area including a plurality of pixels. A plurality of scan lines substantially extended in a row direction and substantially parallel with each other, and a plurality of data lines and a plurality of power lines substantially extended in a column direction and substantially parallel with each other, are formed in the display unit 600. The scan lines, the data lines, and the power lines are connected to the plurality of pixels. The plurality of pixels are arranged substantially in a matrix format.

The scan driver 200 is connected to the plurality of scan lines, and generates a plurality of scan signals ODD_S[1] to ODD_S[n] and EVEN_S[1] to EVEN_S[n] according to the first driving control signal CONT1. The plurality of scan lines may include n odd-numbered scan lines arranged as odd-numbered lines and n even-numbered scan lines arranged as even-numbered lines. The plurality of scan signals include scan signals ODD_S[1] to ODD_S[n] of the odd-numbered lines and scan signals EVEN_S[1] to EVEN_S[n] of the even-numbered lines. The scan signals ODD_S[1] to ODD_S

[n] are applied to the n odd-numbered scan lines, and the scan signals EVEN_S[1] to EVEN_S[n] are applied to the n even-numbered scan lines.

The data driver 300 is connected to the plurality of data lines, and samples and holds the image data signal ImD input according to the second driving control signal CONT2 and transmits a plurality of data signals data[1] to data[m] to the respective data lines. The data driver 300 applies data signals having a predetermined voltage range to the plurality of data lines corresponding to a scan signal of a gate-on voltage applied to each of the scan lines.

The light emission driver 400 is connected to a plurality of light emission lines, generates a plurality of light emission signals EM[1] to EM[n] according to the third driving control signal CONT3, and applies the plurality of light emission signals to the plurality of light emission lines.

The power supply 500 generates a first power source voltage ELVDD, a second power source voltage ELVSS, and an initialization voltage Vint, and supplies the generated voltages to power lines connected to the plurality of pixels. The first power source voltage ELVDD and the second power source voltage ELVSS provide a pixel driving current. The initialization voltage Vint initializes a gate voltage of a driving transistor included in each pixel.

Figure 2:
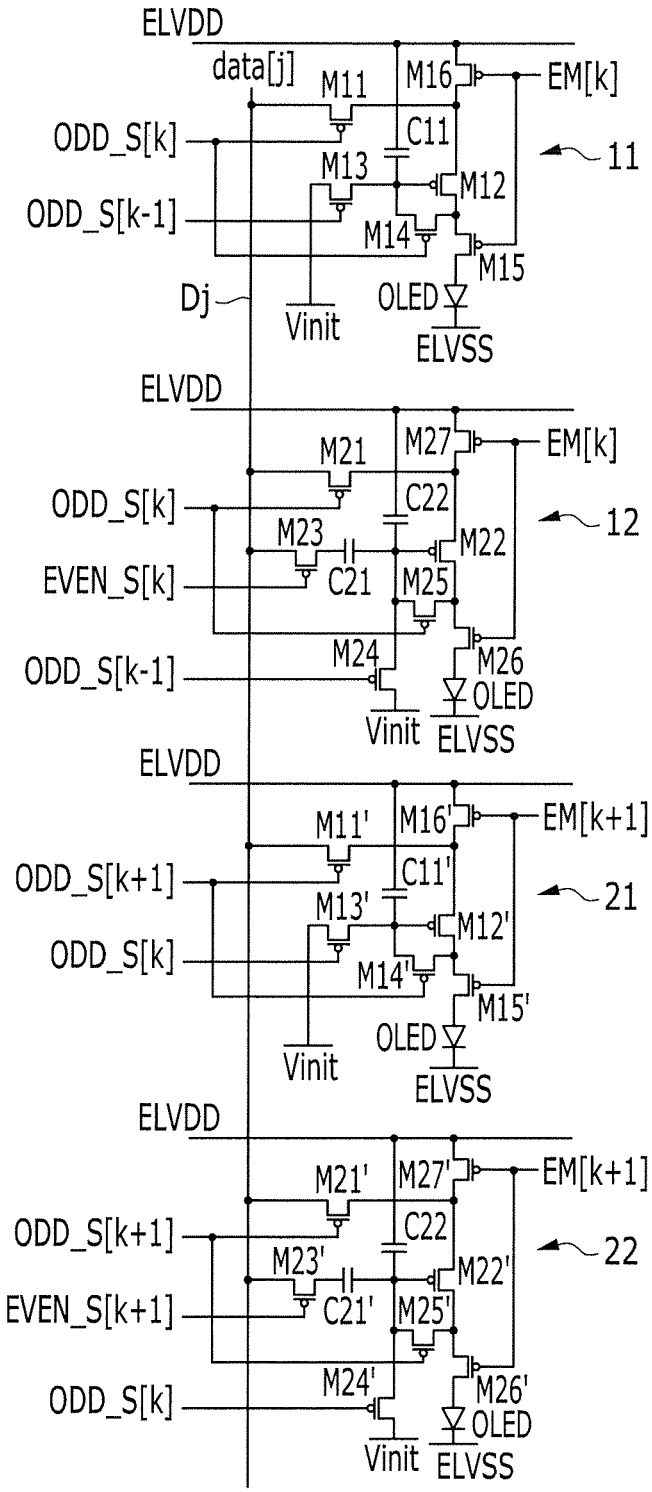
FIG. 2 is a circuit diagram of pixels according to an exemplary embodiment of the present invention.

FIG. 2 is a circuit diagram of pixels according to an exemplary embodiment of the present invention.

FIG. 2 is a circuit diagram of pixels included in the display unit 600 of the display device 10 shown in FIG. 1, and exemplarily illustrates a pixel 11 of the k-th odd-numbered line, a pixel 12 of the k-th even-numbered line, a pixel 21 of the (k+1)-th odd-numbered line, and a pixel 22 of the (k+1)-th even-numbered line (here, k is an integer, 1<k<n).

The pixel 11 of the k-th odd-numbered line includes an organic light emitting diode OLED, a switching transistor M11, a driving transistor M12, an initialization transistor M13, a compensation transistor M14, a first light emitting transistor M15, a second light emitting transistor M16, and a storage capacitor C11.

The switching transistor M11 includes a gate electrode to which the scan signal ODD_S[k] of the k-th odd-numbered line is applied, a first electrode to which the data signal data[j] is applied, and a second electrode connected with a first electrode of the driving transistor M12. The switching transistor M11 is turned on by the scan signal ODD-S[k] of the k-th odd-numbered line and transmits the data signal data[j] applied to the data line Dj to the driving transistor M12.

The driving transistor M12 includes a gate electrode connected to a second electrode of the initialization transistor M13, the first electrode connected to the second electrode of the switching transistor M11, and a second electrode connected to a first electrode of the first light emitting transistor M15.

The initialization transistor M13 includes a gate electrode to which the scan signal ODD_S[k−1] of the (k−1)-th odd-numbered line is applied, a first electrode to which an initialization voltage Vinit is applied, and the second electrode connected to the gate electrode of the driving transistor M12. The initialization transistor M13 is turned on by the scan signal ODD_S[k−1] of the (k−1)-th odd-numbered line and initializes the driving transistor M12 by transmitting the initialization voltage Vinit to the gate electrode of the driving transistor M12.

The compensation transistor M14 includes a gate electrode to which the scan signal ODD_S[k] of the k-th odd-numbered line is applied, a first electrode connected to the second electrode of the driving transistor M12, and a second electrode connected to the gate electrode of the driving transistor M12. The compensation transistor M14 is turned on by the k-th odd-numbered line and diode-connects the driving transistor M12.

The first light emitting transistor M15 includes a gate electrode connected to the k-th light emission line, a first electrode connected to the second electrode of the driving transistor M12, and a second electrode connected to an anode of the organic light emitting diode OLED. The first light emitting transistor M15 is turned on by the light emission signal EM[k] applied to the k-th light emission line and connects the second electrode of the driving transistor M12 to the anode of the organic light emitting diode OLED.

The second light emitting transistor M16 includes a gate electrode connected to the k-th light emission line, a first electrode to which the first power source voltage ELVDD is applied, and a second electrode connected with the first electrode of the driving transistor M12. The second light emitting transistor M16 is turned on by the k-th light emission signal EM[k] and transmits the first power source voltage ELVDD to the first electrode of the driving transistor M12.

The storage capacitor C11 includes a first electrode connected to the gate electrode of the driving transistor M12 and a second electrode connected to the first power source voltage ELVDD. The storage capacitor C11 stores a first data signal that is compensated for a threshold voltage of the driving transistor M12.

The pixel 12 of the k-th even-numbered line includes an organic light emitting diode OLED, a first switching transistor M21, a driving transistor M22, a second switching transistor M23, an initialization transistor M24, a compensation transistor M25, a first light emitting transistor M26, a second light emitting transistor M27, a first capacitor C21, and a second capacitor C22.

The first switching transistor M21 includes a gate electrode to which the scan signal ODD_S[k] of the k-th odd-numbered line is applied, a first electrode to which the data signal data[j] is applied, and a second electrode connected to the first electrode of the driving transistor M22. The first switching transistor M21 is turned on by the scan signal ODD_S[k] of the k-th odd-numbered line and transmits the data signal applied to the data line Dj to the driving transistor M22.

The driving transistor M22 includes a gate electrode connected to the second electrode of the initialization transistor M24, a first electrode connected to the second electrode of the first switching transistor M21, and a second electrode connected to a first electrode of the first light emitting transistor M26.

The second switching transistor M23 includes a gate electrode to which the scan signal EVEN_S[k] of the k-th even-numbered line is applied, a first electrode to which the data signal data[j] is applied, and a second electrode connected to a first electrode of the first capacitor C21. The second switching transistor M23 is turned on by the scan signal EVEN_S[k] of the k-th even-numbered line and transmits the data signal data[j] applied to the data line Dj to the gate electrode of the driving transistor M22.

The initialization transistor M24 includes a gate electrode to which the scan signal ODD_S[k−1] of the (k−1)-th odd-numbered line is applied, a first electrode to which the initialization voltage Vinit is applied, and a second electrode connected to the gate electrode of the driving transistor M22. The initialization transistor M24 is turned on by the scan signal ODD_S[k−1] of the (k−1)-th odd-numbered line and initializes the driving transistor M22 by transmitting the initialization voltage Vinit to the gate electrode of the driving transistor M22.

The compensation transistor M25 includes a gate electrode to which the scan signal ODD_S[k] of the k-th odd-numbered line is applied, a first electrode connected to the second electrode of the driving transistor M22, and a second electrode connected to the gate electrode of the driving transistor M22. The compensation transistor M25 is turned on by the scan signal ODD_S[k] of the k-th odd-numbered line and diode-connects the driving transistor M22.

The first light emitting transistor M26 includes a gate electrode connected to the k-th light emission line, a first electrode connected to the second electrode of the driving transistor M22, and a second electrode connected to an anode of the organic light emitting diode OLED. The first light emitting transistor M26 is turned on by the light emission signal EM[k] applied to the k-th light emission line and connects the second electrode of the driving transistor M22 to the anode of the organic light emitting diode OLED.

The second light emitting transistor M27 includes a gate electrode connected to the k-th light emission line, a first electrode to which the first power source voltage ELVDD is applied, and a second electrode connected to the first electrode of the driving transistor M22. The second light emitting transistor M27 is turned on by the k-th light emission signal EM[k] and transmits the first power source voltage ELVDD to the first electrode of the driving transistor M22.

The first capacitor C21 includes a first electrode connected to the second electrode of the second switching transistor M23 and a second electrode connected to the gate electrode of the driving transistor M22. When the second switching transistor M23 is turned on by the scan signal EVEN_S[k] of the k-th even-numbered line, the data signal data[j] of the date line Dj is transmitted to the gate electrode of the driving transistor M22 due to coupling by the first capacitor C21.

The second capacitor C22 includes a first electrode connected to the gate electrode of the driving transistor M22 and a second electrode connected to the first power source voltage ELVDD. The second capacitor C22 stores a second data signal (Vdat+Vth) that is compensated for a threshold voltage of the driving transistor M22.

The above-described plurality of transistors M11 to M16 and M21 to M27 are P-channel field effect transistors. A gate-on voltage that turns on the P-channel field effect transistor is a logic low-level voltage, and a gate-off voltage that turns off the P-channel field effect transistor is a logic high-level voltage. In several embodiments, the plurality of transistors M11 to M16 and M21 to M27 may be N-channel field effect transistors, and in this case, a gate-on voltage that turns on the N-channel field effect transistor is a logic high-level voltage, and a gate-off voltage that turns off the N-channel field effect transistor is a logic low-level voltage.

The pixel 21 of the (k+1)-th odd-numbered line is formed substantially the same as the pixel 11 of the k-th odd-numbered line, and the pixel 22 of the (k+1)-th even-numbered line is formed substantially the same as the pixel 12 of the k-th even-numbered line.

In the display unit 600, a pixel group including the pixel 11 of the k-th odd-numbered line and the pixel 12 of the k-th even-numbered line may be arranged in a (n×m) matrix format.

Hereafter, a method for driving the display device 10 including the pixels of FIG. 2 will be described in further detail with reference to FIG. 3.

Figure 3:
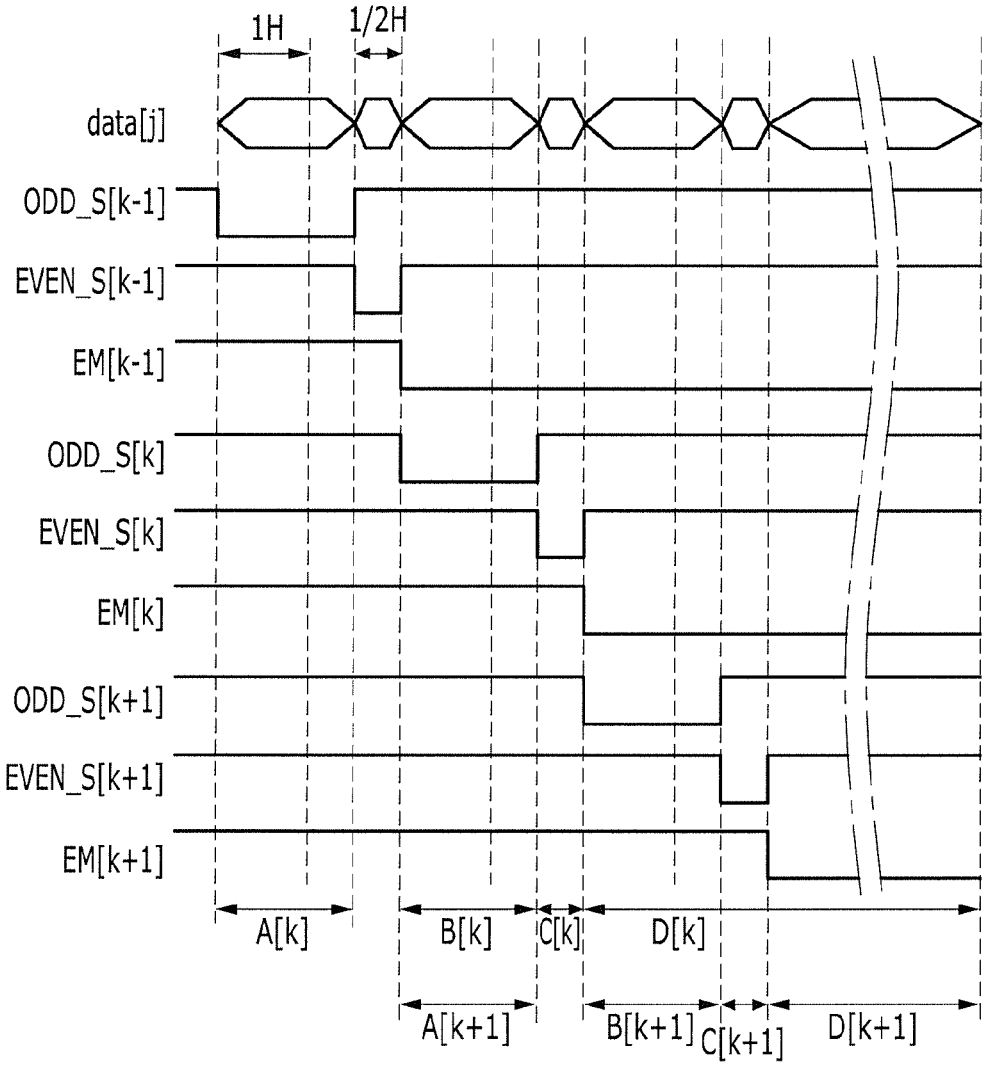
FIG. 3 is a timing diagram of a driving method of the display device according to an exemplary embodiment of the present invention.

FIG. 3 is a timing diagram of a driving method of the display device according to an exemplary embodiment of the present invention.

Referring to FIG. 3, a driving method of the display device 10 includes a reset step A for resetting the driving transistor of each of the pixels of the odd-numbered lines and the pixels of the even-numbered lines, a data writing and threshold voltage compensation step B for compensating a threshold voltage of the pixels of the odd-numbered lines and the pixels of the even-numbered lines and writing data in the pixels of the odd-numbered lines, a data writing step C for writing data in the pixels of the even-numbered lines, and a light emission step D for concurrently (e.g., simultaneously) emitting light from the pixels of the odd-numbered lines and the pixels of the even-numbered lines.

In the reset step A, the scan driver 200 resets gate voltages of the driving transistors M12 and M22 by applying the scan signal ODD_S[k−1] of the (k−1)-th odd-numbered line to the pixel 11 of the k-th odd-numbered line and the pixel 12 of the k-th even-numbered line. That is, the pixel 11 of the k-th odd-numbered line and the pixel 12 of the k-th even-numbered line perform the reset step A for an A[k] period during which the scan signal ODD_S[k−1] of the (k−1)-th odd-numbered line is applied as a logic low-level voltage.

In the data writing and threshold voltage compensation step B, the scan driver 200 applies the scan signal ODD_S[k] of the k-th odd-numbered line to the pixel 11 of the k-th odd-numbered line and the pixel 12 of the k-th even-numbered line. In this case, the data driver 300 applies a first data signal of the k-th odd-numbered line to the data line Dj corresponding to the scan signal ODD_S[k] of the k-th odd-numbered line. The first data signal having a voltage that is compensated for a threshold voltage of the driving transistor M12 according to the scan signal ODD_S[k] of the k-th odd-numbered line, is applied to the pixel 11 of the k-th odd-numbered line. In addition, the threshold voltage of the driving transistor M22 included in the pixel 12 of the k-th even-numbered line is compensated for according to the scan signal ODD_S[k] of the k-th odd-numbered line. That is, the pixel 11 of the k-th odd-numbered line and the pixel 12 of the k-th even-numbered line perform the data writing and threshold voltage compensation step B for a period B[k] during which the scan signal ODD_S[k] of the k-th odd-numbered line is applied as a logic low-level voltage.

In the data writing step C. the scan driver 200 applies the scan signal EVEN_S[k] of the k-th even-numbered line to the pixel 12 of the k-th even-numbered line. In this case, the data driver 300 applies a second data signal of the k-th even-numbered line to the data line Dj corresponding to the scan signal EVEN_S[k] of the k-th even-numbered line. The second data signal having a voltage that is compensated for a threshold voltage of the driving transistor M22 according to the scan signal EVEN_S[k] of the k-th even-numbered line, is applied to the pixel 12 of the k-th even-numbered line. That is, the pixel 12 of the k-th even-numbered line performs the data writing step C for a period C[k] during which the scan signal EVEN_[k] of the even-numbered line is applied as a logic low-level voltage.

In the light emission step D, the light emission driver 400 controls the pixel 11 of the k-th odd-numbered line and the pixel 12 of the k-th even-numbered line to concurrently (e.g., simultaneously) emit light by applying the k-th light emission signal EM[k] to the pixel 11 of the k-th odd-numbered line and the pixel 12 of the k-th even-numbered line. That is, the pixel 11 of the k-th odd-numbered line and the pixel 12 of the k-th even-numbered line perform the light emission step D for a period D[k] during which the k-th light emission signal EM[k] is applied as a logic low-level voltage.

The pixel 21 of the (k+1)-th odd-numbered line and the pixel 22 of the (k+1)-th even-numbered line perform the reset step A in the B[k] period during which the pixel 11 of the k-th odd-numbered line and the pixel 12 of the k-th even-numbered line perform the data writing and threshold voltage compensation step B. That is, the pixel 21 of the (k+1)-th odd-numbered line and the pixel 22 of the (k+1)-th even-numbered line perform the reset step A, the data writing and threshold voltage compensation step B, the data writing step C, and the light emission step D after a delay equal to the sum of an active duty (or pulse duration) of the scan signal of the odd-numbered line and an active duty (or pulse duration) of the scan signal of the even-numbered line.

Hereinafter, the driving method of the pixels will be described in further detail.

During the period A[k], the scan signal ODD_S[k] of the (k−1)-th odd-numbered line is applied as a logic low-level voltage. Then, the initialization transistor M13 of the pixel 11 of the k-th odd-numbered line and the initialization transistor M24 of the pixel 12 of the k-th even-numbered line are turned on. Accordingly, the data voltage of the driving transistor M12 included in the pixel 11 of the k-th odd-numbered line is reset to the initialization voltage Vinit. In addition, the gate voltage of the driving transistor M22 included in the pixel 12 of the k-th even-numbered line is reset to the initialization voltage Vinit.

In this case, the data signal data[j] applied to the data line Dj is a data signal to be written into a pixel (not shown) of the (k−1)-th odd-numbered line, and the data signal is written into the pixel of the (k−1)-th odd-numbered line. That is, the period A[k] is a period during which the gate voltages of the driving transistors M12 and M22 respectively included in the pixel 11 of the k-th odd-numbered line and the pixel 12 of the (k−1)-th even-numbered line are reset using the scan signal ODD_S[k−1] of the (k−1)-th odd-numbered line, and at the same time the data signal is written into the pixel of the (k−1)-th odd-numbered line.

The period A[k] may be equal to a 1.5 horizontal (H) period. One horizontal (H) period may be represented as 1H, and corresponds to one cycle of the horizontal synchronization signal Hsync and the data enable signal DE.

After the period A[k], the scan signal EVEN_S[k−1] of the (k−1)-th even-numbered line is applied as a logic low-level voltage during a ½ H. In this case, the data signal data[j] applied to the data line Dj is a data signal to be written into a pixel (not shown) of the (k−1)-th even-numbered line, and the data signal is written into the pixel of the (k−1)-th even-numbered line.

In the period B[k], the scan signal ODD_S[k] of the k-th odd-numbered line is applied as a logic low-level voltage. In this case, the data signal data[j] applied to the data line Dj is a data signal to be written into the pixel 11 of the k-th odd-numbered line. Then, the switching transistor M11 and the compensation transistor M14 of the pixel 11 of the k-th odd-numbered line are turned on. As the compensation transistor M14 is turned on, the driving transistor M12 is diode-connected. The data signal data[j] is transmitted to the driving transistor M12 through the turn-on switching transistor M11. As the driving transistor M12 is diode-connected, a compensated data voltage (Vdat1−Vth1) that corresponds to a threshold voltage Vth1 of the driving transistor M12 is transmitted to the gate electrode of the driving transistor M12. The voltage Vdat1 indicates a voltage of a data signal to be written into the pixel 11 of the k-th odd-numbered line. The data voltage (Vdat1−Vth1) that is compensated for the threshold voltage Vth1 of the driving transistor M12 is stored in the storage capacitor C11.

In addition, the first switching transistor M21 and the compensation transistor M25 of the pixel 12 of the k-th even-numbered line are turned on. As the compensation transistor M25 is turned on, the driving transistor M22 is diode-connected. The data signal data[j] is transmitted to the driving transistor M22 through the turn-on first switching transistor M21, and a data voltage (Vdat1−Vth2) that is compensated for the threshold voltage Vth2 of the driving transistor M22 is transmitted to the gate electrode of the driving transistor M22. The data voltage (Vdat1−Vth2) that is compensated for the threshold voltage Vth2 of the driving transistor M22 is stored in the second capacitor C22.

The period B[k] overlaps a period A[k+1] during which the gate voltages of the driving transistors of the pixel 21 of the (k+1)-th odd-numbered line and the pixel 22 of the (k+1)-th even-numbered line are reset. As the scan signal ODD_S[k] of the k-th odd-numbered line is applied as logic low-level, the initialization transistor M13' included in the pixel 21 of the (k+1)-th odd-numbered line is turned on and the initialization transistor M24' included in the pixel 22 of the (k+1)-th even-numbered line is turned on. Accordingly, the driving transistors M12' and M22' respectively included in the pixel 21 of the (k+1)-th odd-numbered line and the pixel 22 of the (k+1)-th even-numbered line are reset to the initialization voltage Vinit.

In the period C[k], the scan signal EVEN_S[k] of the k-th even-numbered line is applied as a logic low-level voltage. In this case, the data signal data[j] applied to the data line Dj is a data signal to be written into the pixel 12 of the k-th even-numbered line. Then, the second switching transistor M23 of the pixel 12 of the k-th even-numbered line is turned on. The gate electrode of the driving transistor M22 of the pixel 12 of the k-th even-numbered line is in the floating state, and as the second switching transistor M23 is turned on, a data voltage (Vdat2−Vth2) that is compensated for the threshold voltage Vth2 of the driving transistor M22, is transmitted to the gate electrode of the driving transistor M22 due to coupling of the first capacitor C21. The voltage Vdat2 indicates a voltage of the data signal to be written into the pixel 12 of the k-th even-numbered line.

During the period B[k], the data line Dj is applied with the voltage Vdat1, and the compensated voltage (Vdat1−Vth2) is applied to the gate electrode of the driving transistor M22. When the voltage applied to the data line Dj is changed to the voltage Vdat2 during the period C[k], a voltage change occurs due to coupling of the first capacitor C21 and thus the gate voltage of the driving transistor M22 becomes the voltage (Vdat2−Vdat1). That is, the gate voltage of the driving transistor M22 becomes (Vdat1−Vth2)+(Vdat2−Vdat1)=Vdat2−Vth2.

During the period D[k], the k-th light emission signal EM[k] is applied as a logic low-level voltage. Accordingly, the first light emission transistor M15 and the second light emission transistor M16 of the pixel 11 of the k-th odd-numbered line are turned on, and the first light emission transistor M26 and the second light emission transistor M27 of the pixel 12 of the k-th even-numbered line are turned on. The driving transistor M12 of the pixel 11 of the k-th odd-numbered line controls the organic light emitting diode OLED to emit light by flowing a current corresponding to the voltage (Vdat1−Vth1) applied to the gate electrode. The driving transistor M22 of the pixel 12 of the k-th even-numbered line controls the organic light emitting diode OLED to emit light by flowing a current corresponding to the voltage (Vdat2−Vth2) applied to the gate electrode. That is, the pixel 11 of the k-th odd-numbered line and the pixel 12 of the k-th even-numbered line concurrently (e.g., simultaneously) emit light according to the k-th light emission signal EM[k].

The scan signal ODD_S[k+1] of the (k+1)-th odd-numbered line is applied as a logic low-level voltage delayed by 2H from the scan signal ODD_S[k] of the k-th odd-numbered line, and the scan signal EVEN_S[k+1] of the (k+1)-th even-numbered line is applied as a logic low-level voltage delayed by 2H from the scan signal EVEN_S[k] of the k-th even-numbered line. Accordingly, a period A[k+1] during which the pixel 21 of the (k+1)-th odd-numbered line and the pixel 22 of the (k+1)-th even-numbered line perform a reset step, a period B[k+1] during which a data writing and threshold voltage compensation step is performed, a period C[k+1] during which a data writing step is performed, and a period D[k+1] during which a light emission step is performed, are delayed by 2H from the corresponding periods of the pixel 11 of the k-th odd-numbered line and the pixel 12 of the k-th even-numbered line.

As described above, the data writing and threshold voltage compensation step of the odd-numbered line pixel and the threshold voltage compensation step of the even-numbered line are concurrently (e.g., simultaneously) performed during 1.5H so that the time available for threshold voltage compensation of the driving transistors can be sufficiently assured.

Figure 4:
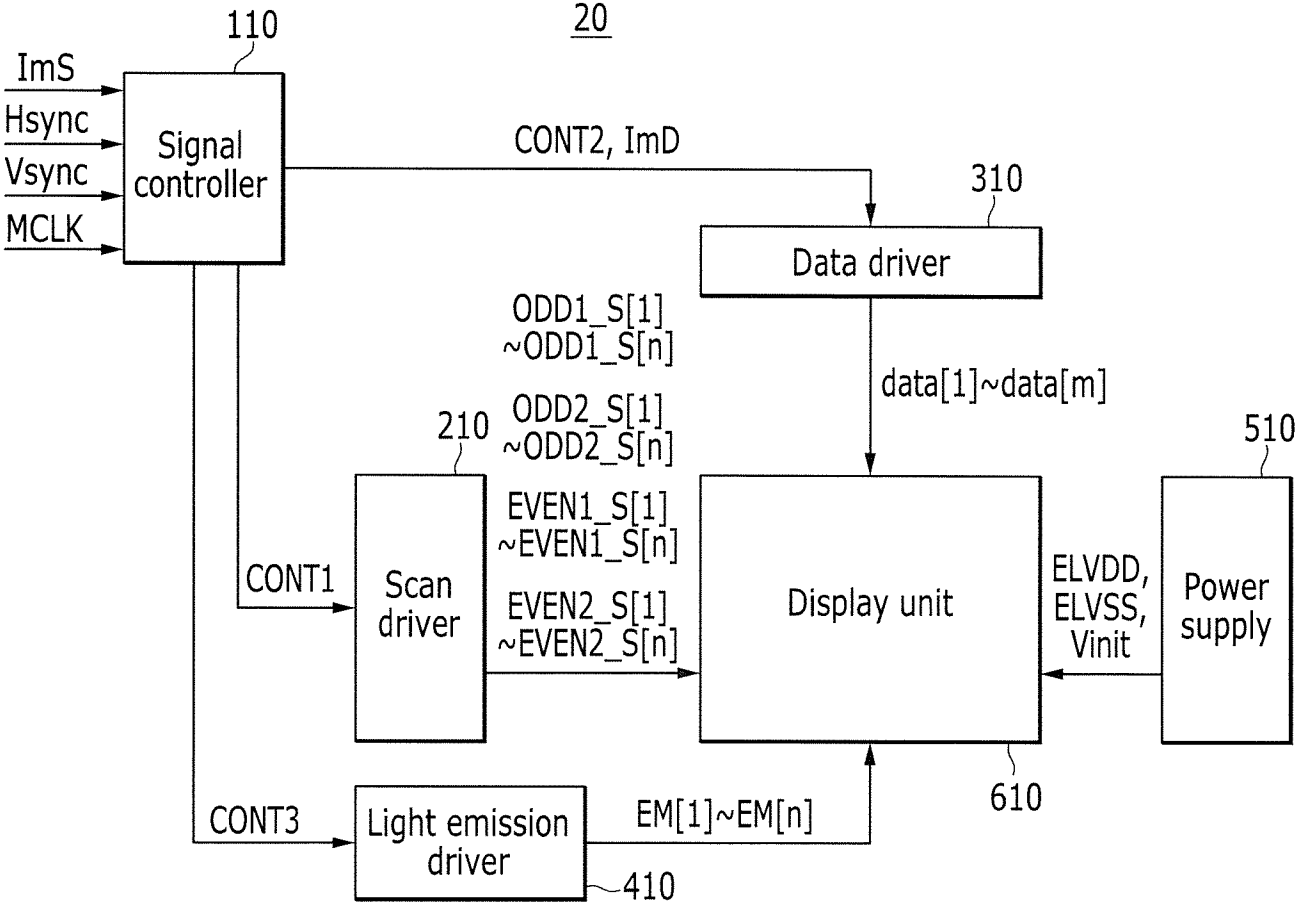
FIG. 4 is a block diagram of a display device according to another exemplary embodiment of the present invention.

FIG. 4 is a block diagram of a display device according to another exemplary embodiment of the present invention.

Referring to FIG. 4, a display device 20 includes a signal controller 110, a scan driver 210, a data driver 310, a light emission driver 410, a power supply 510, and a display unit 610.

The signal controller 110 receives an image signal ImS and a synchronization signal input from an external device. The input image signal ImS includes luminance information of a plurality of pixels. The luminance has a predetermined number of grays (or gray levels), for example, $1024=2^{10}$, $256=2^{8}$ or $64=2^{6}$. The synchronization signal includes a horizontal synchronization signal Hsync, a vertical synchronization signal Vsync, and a main clock signal MCLK.

The signal controller 110 generates first to third driving control signals CONT1, CONT2, CONT3 and an image data signal ImD according to the video signal ImS, the horizontal synchronization signal Hsync, the vertical synchronization signal Vsync, and the main clock signal MCLK.

The signal controller 110 generates the image data signal ImD by dividing the video signal ImS into a frame unit according to the vertical synchronization signal Vsync and dividing the image data signal ImS into a scan line unit according to the horizontal synchronization signal Hsync. The signal controller 110 transmits the image data signal ImD and the second driving control signal CONT2 to the data driver 310.

The display unit 610 has a display area including a plurality of pixels. A plurality of scan lines substantially extended in a row direction and substantially parallel with each other, and a plurality of data lines and a plurality of power lines substantially extended in a column direction and substantially parallel with each other, are formed in the display unit 610, and the scan lines, the data lines, and the power lines are connected to the plurality of pixels. The plurality of pixels are arranged substantially in a matrix format.

The scan driver 210 is connected to the plurality of scan lines, and generates a plurality of scan signals ODD1_S[1] to ODD1_S[n], ODD2_S[1] to ODD2_S[n], EVEN1_S[1] to EVEN1_S[n], and EVEN2_S[1] to EVEN2_S[n] according to the first driving control signal CONT1. The plurality of scan lines may include 2n odd-numbered scan lines arranged as odd-numbered lines and 2n even-numbered scan lines arranged as even-numbered lines. The plurality of scan signals include first and second scan signals ODD1_S[1] to ODD1_S[n] and ODD2_S[1] to ODD2_S[n] of odd-numbered lines, and third and fourth scan signals EVEN1_S[1] to EVEN1_S[n] and EVEN2_S[1] to EVEN2_S[n]. The first and second scan signals are applied to the 2n odd-numbered scan lines, and the third and fourth scan signals are applied to the 2n even-numbered scan lines.

The data driver 310 is connected to the plurality of data lines, and samples and holds the image data signal ImD input according to the second driving control signal CONT2 and transmits a plurality of data signals data[1] to data[m] to the respective data lines. The data driver 310 applies the data signals having a predetermined voltage range to the plurality of data lines corresponding to a scan signal of a gate-on voltage applied to each of the scan lines.

The light emission driver 410 is connected to a plurality of light emission lines, generates a plurality of light emission signals EM[1] to EM[n] according to the third driving control signal CONT3, and applies the plurality of light emission signals to the plurality of light emission lines.

The power supply 510 generates a first power source voltage ELVDD, a second power source voltage ELVSS, and an initialization voltage Vint, and supplies the generated voltages to power lines connected to the plurality of pixels. The first power source voltage ELVDD and the second power source voltage ELVSS provide a pixel driving current. The initialization voltage Vint initializes a gate voltage of a driving transistor included in each pixel.

Figure 5:
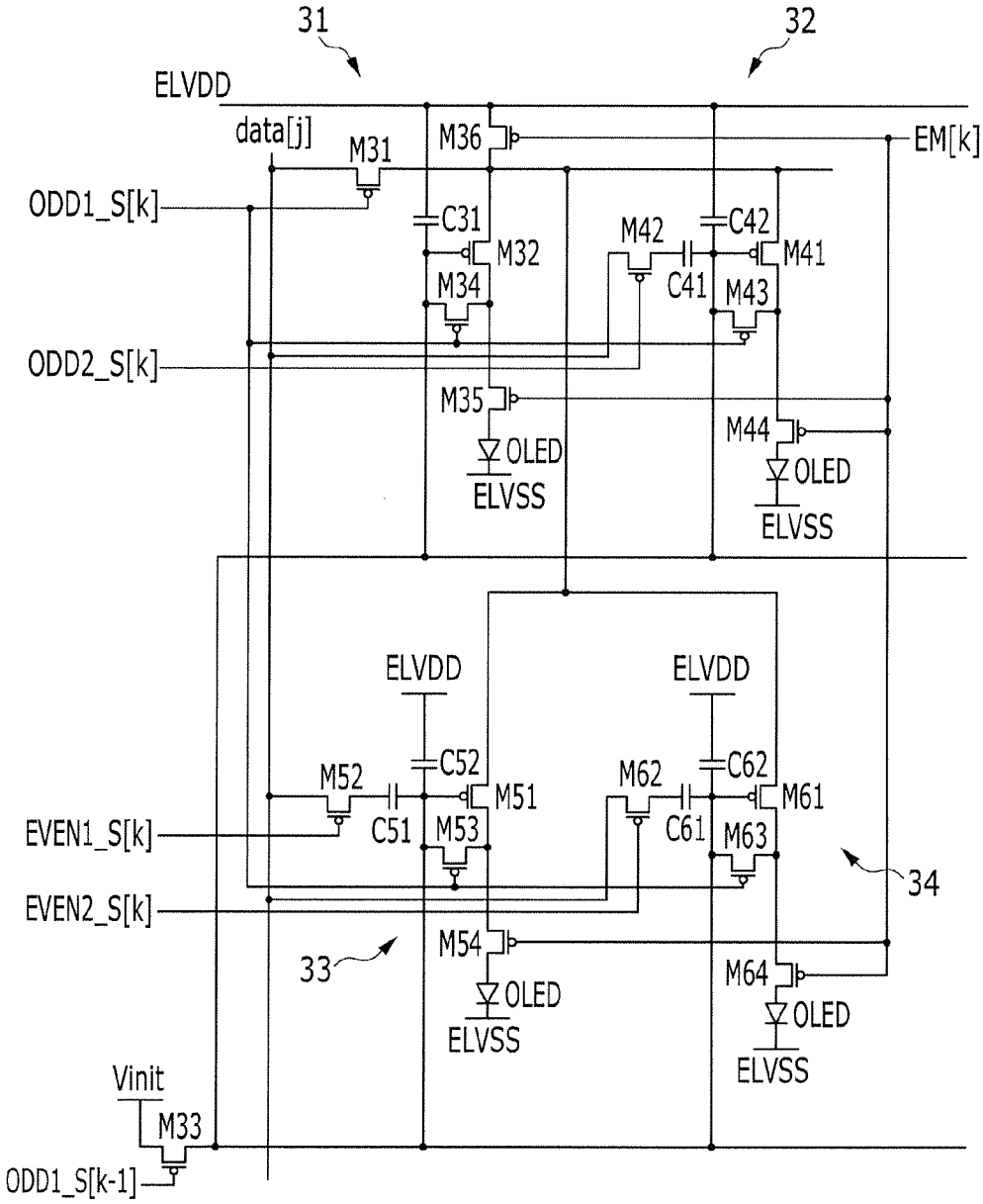
FIG. 5 is a circuit diagram of pixels according to an exemplary embodiment of the present invention.

FIG. 5 is a circuit diagram of a pixel according to an exemplary embodiment of the present invention.

FIG. 5 is a circuit diagram of pixels included in the display unit 610 of the display device 20 shown in FIG. 4, and exemplarily illustrates a first pixel 31 of the k-th odd-numbered line, a second pixel 32 of the k-th odd-numbered line, a third pixel 33 of the k-th even-numbered line, and a fourth pixel 34 of the k-th even-numbered line (here, k is an integer, $1<k<n$).

The first pixel 31 of the k-th odd-numbered line includes an organic light emitting diode OLED, a switching transistor M31, a first driving transistor M32, an initialization transistor M33, a compensation transistor M34, a first light emitting transistor M35, a second light emitting transistor M36, and a storage capacitor C31.

The switching transistor M31 includes a gate electrode to which the first scan signal ODD1_S[k] of the k-th odd-numbered line is applied, a first electrode to which a data signal data[j] is applied, and a second electrode connected to a first electrode of the first driving transistor M32. The switching transistor M31 is turned on by the first scan signal ODD1_S[k] of the k-th odd-numbered line and transmits the data signal data[j] applied to the data line Dj to the first driving transistor M32.

The first driving transistor M32 includes a gate electrode connected to a second electrode of the initialization transistor M33, a first electrode connected to the second electrode of the switching transistor M31, and a second electrode connected to a first electrode of the first light emitting transistor M35.

The initialization transistor M33 includes a gate electrode to which the first scan signal ODD1_S[k−1] of the (k−1)-th odd-numbered line is applied, a first electrode to which the initialization voltage Vinit is input, and a second electrode connected to the gate electrode of the first driving transistor M32. The initialization transistor M33 is turned on by the (k−1)-th first scan signal ODD1_S[k−1] of the (k−1)-th odd-numbered line and initializes the first driving transistor M32 by transmitting the initialization voltage Vinit to the gate electrode of the first driving transistor M32.

The compensation transistor M34 includes a gate electrode to which the first scan signal ODD1_S[k] of the k-th odd-numbered line is applied, a first electrode connected to the second electrode of the first driving transistor M32, and a second electrode connected to the gate electrode of the first driving transistor M32. The compensation transistor M34 is turned on by the first scan signal ODD1_S[k] of the k-th odd-numbered line and diode-connects the first driving transistor M32.

The first light emitting transistor M35 includes a gate electrode connected to the k-th light emission line, a first electrode connected to the second electrode of the first driving transistor M32, and a second electrode connected to an anode of the organic light emitting diode OLED. The first light emitting transistor M35 is turned on by the light emission signal EM[k] applied to the k-th light emission line and connects the second electrode of the first driving transistor M32 to the anode of the organic light emitting diode OLED.

The second light emitting transistor M36 includes a gate electrode connected to the k-th light emission line, a first electrode to which a first power source voltage ELVDD is applied, and a second electrode connected to the first electrode of the first driving transistor M32. The second light emitting transistor M36 is turned on by the k-th light emission signal EM[k] and transmits the first power source voltage ELVDD to the first electrode of the first driving transistor M32.

The storage capacitor C31 includes a first electrode connected to the gate electrode of the first driving transistor M32 and a second electrode connected to the first power source voltage ELVDD. The storage capacitor C31 stores a first data signal that is compensated for a threshold voltage of the first driving transistor M32.

The second pixel 32 of the k-th odd-numbered line includes an organic light emitting diode OLED, a second driving transistor M41, a second switching transistor M42, a second compensation transistor M43, a third light emitting transistor M44, a first capacitor C41, and a second capacitor C42.

The second driving transistor M41 includes a gate electrode connected to the second electrode of the initialization transistor M33, a first electrode connected to the second electrode of the switching transistor M31 and a second electrode of the second light emitting transistor M36, and a second electrode connected to a first electrode of the third light emitting transistor M44. The second driving transistor M41 is initialized by the initialization voltage Vinit transmitted through the initialization transistor M33 that is turned on by the (k−1)-th first scan signal ODD1_S[k−1] of the (k−1)-th odd-numbered line.

The second switching transistor M42 includes a gate electrode to which a second scan signal ODD2_S[k] of the k-th odd-numbered line is applied, a first electrode to which the data signal data[j] is input, and a second electrode connected to the first electrode of the first capacitor C41. The second switching transistor M42 is turned on by the second scan signal ODD2_S[k] of the k-th odd-numbered line and transmits the data signal data[j] applied to the data line Dj to the gate electrode of the driving transistor M41.

The second compensation transistor M43 includes a gate electrode to which the first scan signal ODD1_S[k] of the k-th odd-numbered line is applied, a first electrode connected to the second electrode of the second driving transistor M41, and a second electrode connected to the gate electrode of the second driving transistor M41. The compensation transistor M43 is turned on by the first scan signal ODD1_S[k] of the k-th odd-numbered line and diode-connects the second driving transistor M41.

The third light emitting transistor M44 includes a gate electrode connected to the k-th light emission line, a first electrode connected to the second electrode of the second driving transistor M41, and a second electrode connected to the anode of the organic light emitting diode OLED. The third light emitting transistor M44 is turned on by the light emission signal EM[k] applied to the k-th light emission line and connects the second electrode of the second driving transistor M41 to the anode of the organic light emitting diode OLED.

The first capacitor C41 includes a first electrode connected to the second electrode of the second switching transistor M42 and a second electrode connected to the gate electrode of the second driving transistor M41. When the second switching transistor M42 is turned on by the second scan signal ODD2_S[k] of the k-th odd-numbered line, the data signal data[j] of the data line Dj is transmitted to the gate electrode of the second driving transistor M41 due to coupling of the first capacitor C41.

The second capacitor C42 includes a first electrode connected to the gate electrode of the second driving transistor M41 and a second electrode connected to the first power source voltage ELVDD. The second capacitor C42 stores a second data signal that is compensated for the threshold voltage of the second driving transistor M41.

The third pixel 33 of the k-th even-numbered line includes an organic light emitting diode OLED, a third driving transistor M51, a third switching transistor M52, a third compensation transistor M53, a fourth light emitting transistor M54, a third capacitor C51, and a fourth capacitor C52.

The third driving transistor M51 includes a gate electrode connected to the second electrode of the initialization transistor M33, a first electrode connected to the second electrode of the switching transistor M31 and the second electrode of the second light emitting transistor M36, and a second electrode connected to a first electrode of the fourth light emitting transistor 54. The third driving transistor M51 is initialized by the initialization voltage Vinit transmitted through the initialization transistor M33 that is turned on by the (k−1)-th first scan signal ODD1_S[k−1] of the (k−1)-th odd-numbered line.

The third switching transistor M52 includes a gate electrode to which the first scan signal EVEN1_S[k] of the k-th even-numbered line is applied, a first electrode to which the data signal data[j] is applied, and a second electrode connected to a first electrode of the third capacitor C51. The third switching transistor M52 is turned on by the first scan signal EVEN1_S[k] of the k-th even-numbered line and transmits the data signal data[j] applied to the data line Dj to the gate electrode of the third driving transistor M51.

The third compensation transistor M53 includes a gate electrode to which the first scan signal ODD1_S[k] of the k-th odd-numbered line is applied, a first electrode connected to a second electrode of the third driving transistor M51, and a second electrode connected to a gate electrode of the third driving transistor M51. The third compensation transistor M53 is turned on by the first scan signal ODD1_S[k] of the k-th odd-numbered line and diode-connects the third driving transistor M51.

The fourth light emitting transistor M54 includes a gate electrode connected to the k-th light emission line, a first electrode connected to the second electrode of the third driving transistor M51, and a second electrode connected to the anode of the organic light emitting diode OLED. The fourth light emitting transistor M54 is turned on by the light emission signal EM[k] applied to the k-th light emission line and connects the second electrode of the third driving transistor M51 to the anode of the organic light emitting diode OLED.

The third capacitor C51 includes a first electrode connected to the second electrode of the third switching transistor M52 and a second electrode connected to the gate electrode of the third driving transistor M51. When the second switching transistor M52 is turned on by the first scan signal EVEN1_S

[k] of the k-th even-numbered line, the data signal data[j] of the data line Dj is transmitted to the gate electrode of the third driving transistor M51 due to coupling of the third capacitor C51.

The fourth capacitor C52 includes a first electrode connected to the gate electrode of the third driving transistor M51 and a second electrode connected to the first power source voltage ELVDD. The fourth capacitor C52 stores a third data signal that is compensated for a threshold voltage of the third driving transistor M51.

The fourth pixel 34 of the k-th even-numbered line includes an organic light emitting diode OLED, a fourth driving transistor M61, a fourth switching transistor M62, a fourth compensation transistor M63, a fifth light emitting transistor M64, a fifth capacitor C61, and a sixth capacitor C62.

The fourth driving transistor M61 includes a gate electrode connected to the second electrode of the initialization transistor M33, a first electrode connected to the second electrode of the switching transistor M31 and the second electrode of the second light emitting transistor M36, and a second electrode connected to a first electrode of the fifth light emitting transistor 64. The fourth driving transistor M61 is initialized by the initialization voltage Vinit transmitted through the initialization transistor M33 that is turned on by the first scan signal ODD1_S[k−1] of the (k−1)-th odd-numbered line.

The fourth switching transistor M62 includes a gate electrode to which the second scan signal EVEN2_S[k] of the k-th even-numbered line is applied, a first electrode to which the data signal data[j] is applied, and a second electrode connected to a first electrode of the fifth capacitor C61. The fourth switching transistor M62 is turned on by the second scan signal EVEN2_S[k] of the k-th even-numbered line and transmits the data signal data[j] applied to the data line Dj to the gate electrode of the fourth driving transistor M61.

The fourth compensation transistor M63 includes a gate electrode to which the first scan signal ODD1_S[k] of the k-th odd-numbered line is applied, a first electrode connected to the second electrode of the fourth driving transistor M61, and a second electrode connected to the gate electrode of the fourth driving transistor M61. The fourth compensation transistor M63 is turned on by the first scan signal ODD1_S[k] of the k-th odd-numbered line and diode-connects the fourth driving transistor M61.

The fifth light emitting transistor M64 includes a gate electrode connected to the k-th light emission line, a first electrode connected to the second electrode of the fourth driving transistor M61, and a second electrode connected to the anode of the organic light emitting diode OLED. The fifth light emitting transistor M64 is turned on by the light emission signal EM[k] applied to the k-th light emission line and connects the second electrode of the fourth driving transistor M61 to the anode of the organic light emitting diode OLED.

The fifth capacitor C61 includes a first electrode connected to a second electrode of the fourth switching transistor M62 and a second electrode connected to a gate electrode of the fourth driving transistor M61. When the fourth switching transistor M62 is turned on by the second scan signal EVEN2_S[k] of the k-th even-numbered line, the data signal data[j] of the data line Dj is transmitted to the gate electrode of the fourth driving transistor M61 due to coupling of the fifth capacitor C61.

The sixth capacitor C62 includes a first electrode connected to the gate electrode of the fourth driving transistor M61 and a second electrode connected to the first power source voltage ELVDD. The sixth capacitor C62 stores a fourth data signal that is compensated for a threshold voltage of the fourth driving transistor M61.

The switching transistor M31, the initialization transistor M33, and the second light emission transistor M36 of the pixel 31 of the k-th odd-numbered line may be shared by the second, third, and fourth pixels 32, 33, and 34.

In FIG. 5, the plurality of transistors M31 to M36, M41 to M44, M51 to M54, and M61 to M64 are P-channel field effect transistors. A gate-on voltage that turns on the P-channel field effect transistor is a logic low-level voltage, and a gate-off voltage that turns off the P-channel field effect transistor is a logic high-level voltage. In several embodiments, the plurality of transistors M31 to M36, M41 to M44, M51 to M54, and M61 to M64 may be N-channel field effect transistors, and in this case, a gate-on voltage that turns on the N-channel field effect transistor is a logic high-level voltage and a gate-off voltage that turns off the N-channel field effect transistor is a logic low-level voltage.

In the display unit 610, pixel groups including the first pixel 31 of the k-th odd-numbered line, the second pixel 32 of the k-th odd-numbered line, the third pixel 33 of the k-th even-numbered line, and the fourth pixel 34 of the k-th even-numbered line may be arranged in a (n×m) matrix format.

Hereinafter, a driving method of the display device 20 including the pixels of FIG. 5 will be described with reference to FIG. 6.

Figure 6:
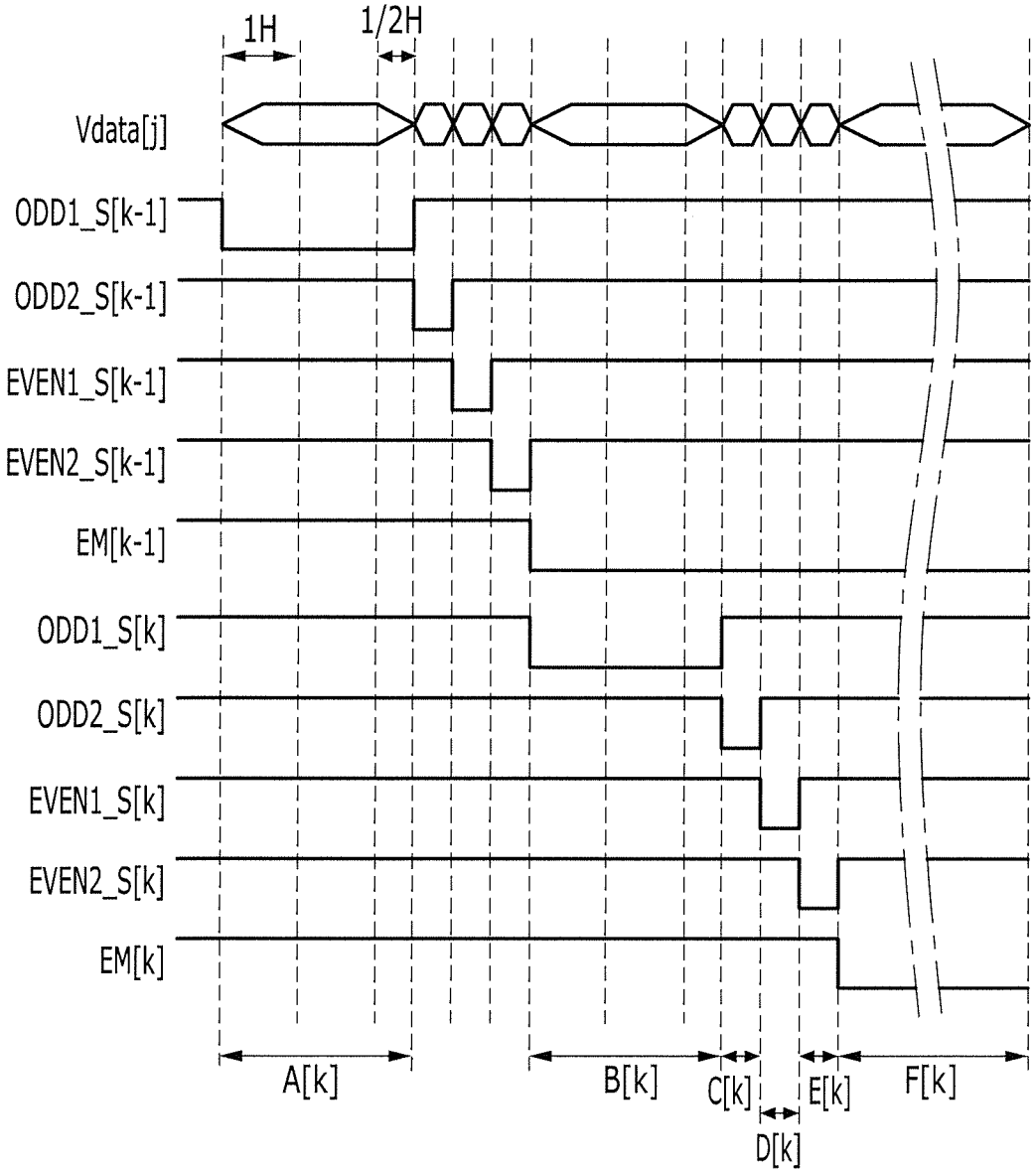
FIG. 6 is a timing diagram of a driving method of the display device according to an exemplary embodiment of the present invention.

FIG. 6 is a timing diagram of a driving method of the display device 20 according to an exemplary embodiment of the present invention.

Referring to FIG. 6, a driving method of the display device 20 includes a reset step A for initializing a driving transistor of each of the first and second pixels of the odd-numbered line and the third and fourth pixels of the even-numbered line, a first data writing and threshold voltage compensation step B for compensating for the threshold voltages of the first and second pixels of the odd-numbered line and the third and fourth pixels of the even-numbered line, a second data writing step C for writing data into the second pixel of the odd-numbered line, a third data writing step D for writing data to the third pixel of the even-numbered line, a fourth data writing step E for writing data to the fourth pixel of the even-numbered line, and a light emission step F for controlling the third and fourth pixels of the even-numbered line to concurrently (e.g., simultaneously) emit light.

In the reset step A, the scan driver 210 resets gate voltages of the respective driving transistors M32, M41, M51, and M61 by applying the first scan signal ODD1_S[k−1] of the (k−1)-th odd-numbered line to the first and second pixels 31 and 32 of the k-th odd-numbered line and the third and fourth pixels 33 and 34 of the k-th even-numbered line. That is, the first and second pixels 31 and 32 of the k-th odd-numbered line and the third pixel 33 and the fourth pixel 34 of the k-th even-numbered line perform the reset step A for a period A[k] during which the first scan signal ODD_S[k−1] of (k−1)-th odd-numbered line is applied as a logic low-level voltage.

In the first data writing and threshold voltage compensation step B, the scan driver 210 applies the first scan signal ODD1_S[k] of the k-th odd-numbered line to the first pixel 31, the second pixel 32, the third pixel 33, and the fourth pixel 34. In this case, the data driver 310 applies the first data signal of the k-th odd-numbered line to the data line Dj corresponding to the first scan signal ODD1_S[k] of the k-th odd-numbered line. According to the first scan signal ODD1_S[k] of the k-th odd-numbered line, the first data signal that is compensated for the threshold voltage of the first driving transistor M32 is input to the pixel 11. In addition, according to the first scan signal ODD1_S[k] of the k-th odd-numbered line, the threshold voltages of the driving transistors M41, M51, and M61 included in the second pixel 32, the third pixel 33, and the fourth pixel 34, respectively, are compensated. That is, the first and second pixels 31 and 32 of the k-th odd-numbered line and the third and fourth pixels 33 and 34 of k-th even-numbered line perform the first data writing and threshold voltage compensation step B for a period B[k] during which the first scan signal ODD1_S[k] of the k-th odd-numbered line is applied as a logic low-level voltage.

In the second data writing step C, the scan driver 210 applies the second scan signal ODD2_S[k] of the k-th odd-numbered line to the second pixel 32 of the k-th odd-numbered line. In this case, the data driver 310 applies the second data signal of the k-th odd-numbered line to the data line Dj corresponding to the second scan signal ODD2_S[k] of the k-th odd-numbered line. According to the scan signal ODD2_S[k] of the k-th odd-numbered line, the second data signal that is compensated for the threshold voltage of the second driving transistor M41 is input to the second pixel 32. That is, the second pixel 32 of the k-th odd-numbered line performs the second data writing step C for a period C[k] during which the second scan signal ODD2_S[k] of the k-th odd-numbered line is applied as a logic low-level voltage.

In the third data writing step D, the scan driver 210 applies a third scan signal EVEN1_S[k] of the k-th even-numbered line to the third pixel 33 of the k-th even-numbered line. In this case, the data driver 310 applies the third data signal of the k-th even-numbered line to the data line Dj corresponding to the third scan signal EVEN1_S[k] of the k-th even-numbered line. According to the third scan signal EVEN1_S[k] of the k-th even-numbered line, the third data signal that is compensated for the threshold voltage of the third driving transistor M51 is input to the third pixel 33. That is, the third pixel 33 of the k-th even-numbered line performs the third data writing step D for a period D[k] during which the third scan signal EVEN1_S[k] of the k-th even-numbered line is applied as a logic low-level voltage.

In the fourth data writing step E, the scan driver 210 applies a fourth scan signal EVEN2_S[k] of the k-th even-numbered line to the fourth pixel 34 of the k-th even-numbered line. In this case, the data driver 310 applies the fourth data signal of the k-th even-numbered line to the data line Dj corresponding to the fourth scan signal EVEN2_S[k] of the k-th even-numbered line. According to the fourth scan signal EVEN2_S[k] of the k-th even-numbered line, the fourth data signal that is compensated for the threshold voltage of the fourth driving transistor M61 is input to the fourth pixel 34. That is, the fourth pixel 34 of the k-th even-numbered line performs the fourth data writing step E for a period E[k] during which the fourth scan signal EVEN2_S[k] of the k-th even-numbered line is applied as a logic low-level voltage.

In the light emission step F, the light emission driver 410 controls the first pixel 31, the second pixel 32, the third pixel 33, and the fourth pixel 34 to concurrently (e.g., simultaneously) emit light by applying the k-th light emission signal EM[k] to the first pixel 31, the second pixel 32, the third pixel 33, and the fourth pixel 34. That is, the first pixel 31, the second pixel 32, the third pixel 33, and the fourth pixel 34 perform the light emission step F for a period F[k] during which the k-th emission signal EM[k] is applied as a logic low-level voltage.

Meanwhile, the first and second pixels of the (k+1)-th odd-numbered line and the third and fourth pixels of the (k+1)-th even-numbered line perform the reset step A, the first data writing and threshold voltage compensation step B, the second data writing step C, the third data writing step D, the fourth data writing step E, and the light emission step F, after a delay by the sum of active duties of the first and second scan signals of the odd-numbered line and active duties of the third and fourth scan signals of the even-numbered line.

Hereinafter, the driving method of the pixels will be described in further detail.

In the period A[k], the scan signal ODD1_S[k−1] of the (k−1)-th odd-numbered line is applied as a logic low-level voltage. Then, the initialization transistor M33 is turned on, and the gate voltages of the first driving transistor M32, the second driving transistor M41, the third driving transistor M51, and the fourth driving transistor M61 are reset to the initialization voltage Vinit.

In this case, the data signal data[j] applied to the data line Dj is a data signal to be written into a first pixel (not shown) of the (k−1)-th odd-numbered line and the data signal is written into the first pixel of the (k−1)-th odd-numbered line. That is, during the period A[k], the gate voltages of the first and second pixels 31 and 32 of the k-th odd-numbered line and the gate voltages of the third and fourth pixels 33 and 34 of the k-th even-numbered line are reset using the first scan signal ODD_S[k−1] of the (k−1)-th odd-numbered line, and at the same the data signal is written into the first pixel of the (k−1)-th odd-numbered line. The period A[k] may have a 2.5H duration.

In the period B[k], the first scan signal ODD1_S[k] of the k-th odd-numbered line is applied as a logic low-level voltage. In this case, the data signal data[j] applied to the data Dj is a data signal to be written into the first pixel 31 of the k-th odd-numbered line. Then, the switching transistor M31 and the compensation transistor M34 of the first pixel 31 are turned on. As the compensation transistor M34 is turned on, the first driving transistor M32 is diode-connected. The data signal data[j] is transmitted to the first driving transistor M32 through the turn-on switching transistor M31. As the first driving transistor M32 is diode-connected, a data voltage (Vdat1−Vth1) that is compensated for the threshold voltage Vth1 of the first driving transistor M32 is transmitted to the gate electrode of the first driving transistor M32. Vdat1 indicates a voltage of the data signal to be written into the first pixel 31 of the k-th odd-numbered line. The data voltage (Vdat1−Vth1) that is compensated for the threshold voltage Vth1 of the first driving transistor M32 is stored in the storage capacitor C31.

In addition, the second compensation transistor M43 of the second pixel 32 of the k-th odd-numbered line is turned on. As the second compensation transistor M43 is turned on, the second driving transistor M41 is diode-connected. The data signal data[j] is transmitted to the second driving transistor M41 through the turn-on switching transistor M31, and a data voltage (Vdat1−Vth2) that is compensated for the threshold voltage Vth2 of the second driving transistor M41 is transmitted to the gate electrode of the second driving transistor M41. The data voltage (Vdat1−Vth2) that is compensated for the threshold voltage Vth2 of the second driving transistor M41 is stored in the second capacitor C42.

In addition, the third compensation transistor M53 of the third pixel 33 of the k-th even-numbered line is turned on. As the third compensation transistor M53 is turned on, the third driving transistor M51 is diode-connected. The data signal data[j] is transmitted to the third driving transistor M51 through the turn-on switching transistor M31, and a data voltage (Vdat1−Vth3) that is compensated for the threshold voltage Vth3 of the third driving transistor M51 is transmitted to the gate electrode of the third driving transistor M51. The data voltage (Vdat1−Vth3) that is compensated for the threshold voltage Vth3 of the third driving transistor M51 is stored in the fourth capacitor C52.

In addition, the fourth compensation transistor M63 of the fourth pixel 34 of the k-th even-numbered line is turned on. As the fourth compensation transistor M63 is turned on, the fourth driving transistor M61 is diode-connected. The data signal data[j] is transmitted to the fourth driving transistor M61 through the turn-on switching transistor M31, and a data voltage (Vdat1−Vth4) that is compensated for the threshold voltage Vth4 of the fourth driving transistor M61 is transmitted to the gate electrode of the fourth driving transistor M61. The data voltage (Vdat1−Vth4) that is compensated for the threshold voltage Vth4 of the fourth driving transistor M61 is stored in the sixth capacitor C62.

In the period C[k], the second scan signal ODD2_S[k] of the k-th odd-numbered line is applied as a logic low-level voltage. In this case, the data signal data[j] applied to the data line Dj is a data signal for the second pixel 32 of the k-th odd-numbered line. The second switching transistor M42 of the second pixel 32 is turned on. The gate electrode of the second driving transistor M41 of the second pixel 32 is in the floating state, and as the second switching transistor M42 is turned on, a data voltage (Vdat2−Vth2) that is compensated for the threshold voltage Vth2 of the second driving transistor M41 is transmitted to the gate electrode of the second driving transistor M41. Vdat2 indicates a voltage of a data signal to be written into the second pixel 32 of the k-th odd-numbered line.

In the period B[k], the voltage Vdat1 is applied to the data line Dj, and a voltage (Vdat1−Vth2) is applied to the gate electrode of the second driving transistor M41. When the voltage applied to the data line Dj is changed to the voltage Vdat2 in the period C[k], the gate voltage of the second driving transistor M41 is changed to the voltage (Vdat2−Vdat1) due to coupling of the first capacitor C41. That is, the gate voltage of the second driving transistor M41 becomes (Vdat1−Vth2)+(Vdat2−Vdat1)=Vdat2−Vth2.

In the period D[k], the third scan signal EVEN1_S[k] of the k-th even-numbered line is applied as a logic low-level voltage. In this case, the data signal data[j] applied to the data line Dj is a data signal for the third pixel 33 of the k-th even-numbered line. The third switching transistor M52 of the third pixel 33 is turned on. The gate electrode of the third driving transistor M51 of the third pixel 33 is in the floating state, and as the third switching transistor M52 is turned on, a data voltage (Vdat3−Vth3) that is compensated for the threshold voltage Vth of the third driving transistor M51 is transmitted to the gate electrode of the third driving transistor M51 due to coupling of the third capacitor C51. Vdat3 indicates a voltage of a data signal to be written into the third pixel 33 of the k-th even-numbered line.

The gate electrode of the third driving transistor M51 is applied with the voltage (Vdat1−Vth3) during the period B[k]. The voltage Vdat2 was applied to the data line Dj during the period C[k]. When a (Vdat3+Vdat2−Vdat1) voltage is applied to the data line Dj during the period D[k], the voltage of the data line Dj is changed to (Vdat3+Vdat2−Vdat1)−Vdat2=(Vdat3−Vdat1) voltage. Accordingly, the gate voltage of the third driving transistor M51 is changed to a voltage corresponding to Vdat3−Vdat1 due to coupling of the third capacitor C51. That is, the gate voltage of the third driving transistor M51 becomes (Vdat1−Vth3)+(Vdat3−Vdat1)=Vdat3−Vth3.

In the period E[k], the fourth scan signal EVEN2_S[k] of the k-th even-numbered line is applied as a logic low-level voltage. In this case, the data signal data[j] applied to the data line Dj is a data signal for the fourth pixel 34 of the k-th even-numbered line. The fourth switching transistor M62 of the fourth pixel 34 is turned on. The gate electrode of the fourth driving transistor M61 of the fourth pixel 34 is in the floating state, and as the fourth switching transistor M62 is turned on, a data voltage (Vdat4−Vth4) that is compensated for the threshold voltage Vth4 of the fourth driving transistor M61 is transmitted to the gate electrode of the fourth driving transistor M61 due to coupling of the fifth capacitor C61. Vdat4 indicates a voltage of a data signal to be written into the fourth pixel 34 of the k-th even-numbered line.

The gate electrode of the fourth driving transistor M61 is applied with (Vdat1−Vth4) voltage during the period B[k]. The data line Dj was applied with the Vdat3 voltage during the period D[k]. When the (Vdat4+Vdat3−Vdat1) voltage is applied to the data line Dj during the period E[k], the voltage of the data line Dj is changed to (Vdat4+Vdat3−Vdat1)−Vdat3=Vdat4−Vdat1 voltage. Accordingly, the gate voltage of the fourth driving transistor M61 is changed to a voltage corresponding to Vdat4−Vdat1 due to coupling of the fifth capacitor C61. That is, the gate voltage of the fourth driving transistor M61 becomes (Vdat1−Vth4)+(Vdat4−Vdat1)=Vdat4−Vth4.

In the period F[k], the k-th light emission signal EM[k] is applied as a logic low-level voltage. Accordingly, the first light emitting transistor M35, the second light emitting transistor M36, the third light emitting transistor M44, the fourth light emitting transistor M54, and the fifth light emitting transistor M64 are turned on. The first driving transistor M32 of the first pixel 31 flows a current corresponding to the voltage (Vdat1−Vth1) applied to the gate electrode of the first driving transistor M32 for light emission of the organic light emitting diode OLED. The second driving transistor M41 of the second pixel 32 flows a current corresponding to the voltage (Vdat2−Vth2) applied to the gate electrode thereof for light emission of the organic light emitting diode OLED. The third driving transistor M51 of the third pixel 33 flows a current corresponding to the voltage (Vdat3−Vth3) applied to the gate electrode thereof for light emission of the organic light emitting diode OLED. The fourth driving transistor M61 of the fourth pixel 34 flows a current corresponding to the voltage (Vdat4−Vth4) applied to the gate electrode thereof for light emission of the organic light emitting diode OLED. That is, the first and second pixels 31 and 32 of the k-th odd-numbered line and the third and fourth pixels 33 and 34 of the k-th even-numbered line concurrently (e.g., simultaneously) emit light according to the k-th light emission signal EM[k].

As described above, the data writing and threshold voltage compensation of the first pixel of the odd-numbered line, the threshold voltage compensation of the second pixel of the odd-numbered line, and the threshold voltage compensation of the third and fourth pixels of the even-numbered line are concurrently (e.g., simultaneously) performed during 2.5H period, and accordingly time available for threshold voltage compensation of the driving transistors can be sufficiently assured.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Accordingly, those skilled in the art will appreciate that various modifications and equivalent embodiments may be possible. Therefore, the true technical protection scope of the present invention will be defined by the technical spirit of the accompanying claims and their equivalents.

DESCRIPTION OF SOME SYMBOLS

10, 20: display device
100, 110: signal controller
200, 210: scan driver
300, 310: data driver
400, 410: light emission driver
500, 510: power supply
600, 610: display unit

What is claimed is:

1. A display device comprising:

a scan driver configured to apply scan signals of a (k−1)-th odd-numbered line and a k-th odd-numbered line to a pixel of the k-th odd-numbered line, and apply the scan signal of the (k−1)-th odd-numbered line, the scan signal of the k-th odd-numbered line, and a scan signal of a k-th even-numbered line to a pixel of the k-th even-numbered line (here, k is an integer and greater than 2); and a data driver configured to apply a first data signal of the k-th odd-numbered line to data lines respectively connected to a pixel of the k-th odd-numbered line and a pixel of the k-th even-numbered line corresponding to the scan signal of the k-th odd-numbered line, and apply a second data signal of the k-th even-numbered line to the data line corresponding to the scan signal of the k-th even-numbered line, wherein a threshold voltage of a driving transistor of the pixel of the k-th odd-numbered line and a threshold voltage of a driving transistor of the pixel of the k-th even-numbered line are compensated for according to the scan signal of the k-th odd-numbered line, and wherein the scan signal applied to the k-th odd-numbered line is different from that applied to the k-th even-numbered line.

2. The display device of claim 1, wherein a gate voltage of the driving transistor of the pixel of the k-th odd-numbered line and a gate voltage of the driving transistor of the pixel of the k-th even-numbered line are reset according to the scan signal of the (k−1)-th odd-numbered line.

3. The display device of claim 1, wherein the first data signal that is compensated for the threshold voltage of the driving transistor according to the scan signal of the k-th odd-numbered line, is input to the pixel of the k-th odd-numbered line.

4. The display device of claim 1, wherein the second data signal that is compensated for the threshold voltage of the driving transistor according to the scan signal of the k-th even-numbered line, is input to the pixel of the k-th even-numbered line.

5. The display device of claim 1, further comprising a light emission driver configured to control the pixel of the k-th odd-numbered line and the pixel of the k-th even-numbered line to concurrently emit light by applying a k-th light emission signal to the pixel of the k-th odd-numbered line and the pixel of the k-th even-numbered line.

6. The display device of claim 1, wherein the pixel of the k-th odd-numbered line comprises:

a switching transistor configured to transmit the first data signal by being turned on by the scan signal of the k-th odd-numbered line; and the driving transistor configured to transmit the first data signal by being diode-connected according to the scan signal of the k-th odd-numbered line.

7. The display device of claim 6, wherein the pixel of the k-th odd-numbered line further comprises an initialization transistor configured to transmit an initialization voltage to a gate electrode of the driving transistor by being turned on by the scan signal of the (k−1)-th odd-numbered line.

8. The display device of claim 6, wherein the pixel of the k-th odd-numbered line further comprises a compensation transistor configured to diode-connect the driving transistor by being turned on by the scan signal of the k-th odd-numbered line.

9. The display device of claim 6, wherein the pixel of the k-th odd-numbered line further comprises a storage capacitor coupled between a gate electrode of the driving transistor and a first power source voltage, to store the first data signal that is compensated for the threshold voltage of the driving transistor.

10. The display device of claim 6, wherein the pixel of the k-th odd-numbered line further comprises:

a first light emission transistor configured to be turned on by a k-th light emission signal applied to the pixel of the k-th odd-numbered line and the pixel of the k-th even-numbered line, to connect a second electrode of the driving transistor to an organic light emitting diode; and a second light emission transistor configured to be turned on by the k-th light emission signal to transmit a first power source voltage to a first electrode of the driving transistor.

11. The display device of claim 1, wherein the pixel of the k-th even-numbered line comprises:

a first switching transistor configured to be turned on by the scan signal of the k-th odd-numbered line to transmit the first data signal;

the driving transistor configured to be diode-connected according to the scan signal of the k-th odd-numbered line to transmit the first data signal;

a second switching transistor configured to be turned on by the scan signal of the k-th even-numbered line to transmit the second data signal to a gate electrode of the driving transistor; and a first capacitor coupled between the gate electrode of the driving transistor and the second switching transistor.

12. The display device of claim 11, wherein the pixel of the k-th even-numbered line further comprises an initialization transistor configured to be turned on by the scan signal of the (k−1)-th odd-numbered line to transmit an initialization voltage to the gate electrode of the driving transistor.

13. The display device of claim 11, wherein the pixel of the k-th even-numbered line further comprises a compensation transistor configured to be turned on by the scan signal of the k-th odd-numbered line to diode-connect the driving transistor.

14. The display device of claim 11, wherein the pixel of the k-th even-numbered line further comprises a second capacitor coupled between the gate electrode of the driving transistor and a first power source voltage to store a second data signal that is compensated for the threshold voltage of the driving transistor.

15. The display device of claim 11, wherein the pixel of the k-th even-numbered line further comprises:

a first light emission transistor configured to be turned on by a k-th light emission signal applied to the pixel of the k-th odd-numbered line and the pixel of the k-th even-numbered line, to transmit a first power source voltage to a first electrode of the driving transistor; and a second light emission transistor configured to be turned on by the k-th light emission signal to connect a second electrode of the driving transistor to an organic light emitting diode.

16. A method for driving a display device including a plurality of pixels, comprising:

resetting gate voltages of driving transistors respectively included in first and second pixels of the pixels by applying a first scan signal to the first and second pixels;

writing a first data signal that is compensated for a threshold voltage of a first driving transistor included in the first pixel to the first pixel by applying a second scan signal and the first data signal to the first pixel;

compensating for a threshold voltage of a second driving transistor included in the second pixel by applying the second scan signal and the first data signal to the second pixel;

writing a second data signal that is compensated for the threshold voltage of the second driving transistor to the second pixel by applying a third scan signal and the second data signal to the second pixel; and controlling the first and second pixels to concurrently emit light by applying a light emission signal to the first and second pixels, wherein the second scan signal and the third scan signal are different from each other.

17. The method for driving the display device of claim 16, wherein the first pixel is a pixel of a k-th odd-numbered line (here, k is an integer, greater than 2), the second pixel is a pixel of a k-th even-numbered line, and the first scan signal is a scan signal of a (k−1)-th odd-numbered line.

18. The method for driving the display device of claim 17, wherein the second scan signal is a scan signal of the k-th odd-numbered line, and the third scan signal is a scan signal of the k-th even-numbered line.

19. The method for driving the display device of claim 16, wherein the writing the first data signal that is compensated for the threshold voltage of the first driving transistor to the first pixel, comprises diode-connecting the first driving transistor and transmitting the first data signal through the first driving transistor according to the second scan signal.

20. The method for driving the display device of claim 16, wherein the compensating the threshold voltage of the second driving transistor comprises diode-connecting the second driving transistor and transmitting the first data signal through the second driving transistor according to the second scan signal.

21. The method for driving the display device of claim 16, wherein the writing the second data signal that is compensated for the threshold voltage of the second driving transistor to the second pixel, comprises applying the second data signal to a capacitor coupled to a gate electrode of the second driving transistor and writing the second data signal to the gate electrode of the second driving transistor via coupling by the capacitor.

22. The method for driving the display device of claim 16, wherein the controlling the first and second pixels to concurrently emit light by applying the light emission signal thereto comprises:

controlling a first organic light emitting diode to emit light by turning on a first light emission transistor coupled between a first organic light emitting diode and the first driving transistor included in the first pixel and a second light emission transistor coupled between the first driving transistor and a first power source voltage, and controlling a second light emitting diode to emit light by turning on a third light emission transistor coupled between a second organic light emitting diode and the second driving transistor included in the second pixel and a fourth light emission transistor coupled between the second driving transistor and the first power source voltage.

23. The method for driving the display device of claim 16, further comprising resetting gate voltages of driving transistors included in third and fourth pixels by applying the first scan signal to the third and fourth pixels.

24. The method for driving the display device of claim 23, further comprising:

compensating for a threshold voltage of a third driving transistor included in the third pixel by applying the second scan signal and the first data signal to the third pixel; and compensating for a threshold voltage of a fourth driving transistor included in the fourth pixel by applying the second scan signal and the first data signal to the fourth pixel.

25. The method for driving the display device of claim 24, further comprising:

writing a third data signal that is compensated for the threshold voltage of the third driving transistor to the third pixel by applying a fourth scan signal and the third data signal to the third pixel; and writing a fourth data signal that is compensated for the threshold voltage of the fourth driving transistor to the fourth pixel by applying a fifth scan signal and the fourth data signal to the fourth pixel.

26. The method for driving the display device of claim 25, wherein the first pixel and the second pixel are pixels of a k-th odd-numbered line, the third and fourth pixels are pixels of a k-th even-numbered line, and the first scan signal is a scan signal of the (k−1)-th odd-numbered line.

27. The method for driving the display device of claim 26, wherein the second scan signal comprises a scan signal that turns on a switching transistor included in the first pixel, the third scan signal comprises a scan signal that turns on a switching transistor included in the second pixel, the fourth scan signal comprises a scan signal that turns on a switching transistor included in the third pixel, and the fifth scan signal comprises a scan signal that turns on a switching transistor included in the fourth pixel.

28. The method for driving the display device of claim 25, wherein the compensating the threshold voltage of the third driving transistor comprises diode-connecting the third driving transistor according to the second scan signal and transmitting the first data signal through the third driving transistor.

29. The method for driving the display device of claim 25, wherein the compensating the threshold voltage of the fourth driving transistor comprises diode-connecting the fourth driving transistor according to the second scan signal and transmitting the first data signal through the fourth driving transistor.

30. The method for driving the display device of claim 29, wherein the writing the third data signal that is compensated for the threshold voltage of the third driving transistor to the third pixel comprises applying the third data signal to a capacitor coupled to a gate electrode of the third driving transistor and writing the third data signal to the gate electrode of the third driving transistor via coupling of the capacitor.

31. The method for driving the display device of claim 29, wherein the writing the fourth data signal that is compensated for the threshold voltage of the fourth driving transistor to the fourth pixel comprises applying the fourth data signal to a capacitor coupled to a gate electrode of the fourth driving transistor and writing the fourth data signal to the gate electrode of the fourth driving transistor via coupling of the capacitor.

32. The method for driving the display device of claim 25, further comprising applying the light emission signal to the third and fourth pixels for concurrent light emission of the third and fourth pixels.

33. The method for driving the display device of claim 32, wherein the applying the light emission signal to the third and fourth pixels for concurrent light emission comprises:

turning on a fourth light emission transistor coupled between a third organic light emitting diode and the third driving transistor included in the third pixel when a first power source voltage is transmitted to a first electrode of the third driving transistor by the light emission signal for light emission of the third organic light emitting diode; and turning on a fifth light emission transistor coupled between a fourth organic light emitting diode and the fourth driving transistor included in the fourth pixel when the first power source voltage is transmitted to a first electrode of the fourth driving transistor by the light emission signal for light emission of the fourth organic light emitting diode.

* * * * *